US005832350A

United States Patent [19]

Kumasaka et al.

[11] Patent Number: 5,832,350

[45] Date of Patent: Nov. 3, 1998

[54] DEVELOPING APPARATUS AND COLOR ELECTROPHOTOGRAPHIC APPARATUS USING THE SAME

[75] Inventors: Takao Kumasaka, Takahagi; Kunio Fukuchi, Hitachioota; Masayasu Anzai, Hitachi; Tatsuo Igawa, Kitaibaraki, all of Japan

[73] Assignees: Hitachi, Ltd.; Hitachi Koki Co., Ltd., both of Tokyo, Japan

[21] Appl. No.: 778,577

[22] Filed: Jan. 3, 1997

[30] Foreign Application Priority Data

| | | | |
|---|---|---|---|
| Jan. 9, 1996 | [JP] | Japan | 8-001190 |
| Feb. 7, 1996 | [JP] | Japan | 8-021346 |
| May 23, 1996 | [JP] | Japan | 8-128434 |

[51] Int. Cl.[6] ..... G03G 15/06; G03G 15/08

[52] U.S. Cl. ..... 399/282; 399/55; 399/272; 399/277; 399/285

[58] Field of Search ..... 399/282, 272, 399/279, 281, 284, 285, 274, 277, 275, 254, 255, 256, 258, 260, 53, 55, 223; 430/120, 107, 111; 492/1, 18

[56] References Cited

U.S. PATENT DOCUMENTS

| | | | |
|---|---|---|---|
| 3,939,801 | 2/1976 | Tanaka et al. | 399/277 X |
| 4,385,829 | 5/1983 | Nakahata et al. | 399/282 |
| 4,508,052 | 4/1985 | Kohyama | 399/282 |
| 4,565,438 | 1/1986 | Folkins | 399/55 |
| 4,887,131 | 12/1989 | Kinoshita et al. | 399/275 |
| 4,974,782 | 12/1990 | Nelson | 492/18 X |
| 5,486,909 | 1/1996 | Takenaka et al. | 399/274 |
| 5,497,225 | 3/1996 | Matsuzuki | 399/223 |
| 5,625,441 | 4/1997 | Sugiyama et al. | 399/272 |
| 5,635,325 | 6/1997 | Inaba et al. | 430/111 X |

FOREIGN PATENT DOCUMENTS

| | | |
|---|---|---|
| 55-77764 | 6/1980 | Japan . |
| 61-239266 | 10/1986 | Japan . |
| 2-48901 | 10/1990 | Japan . |
| 3-59576 | 3/1991 | Japan . |
| 7-20683 | 5/1995 | Japan . |
| 7-43546 | 5/1995 | Japan . |

*Primary Examiner*—Arthur T. Grimley
*Assistant Examiner*—Sophia S. Chen
*Attorney, Agent, or Firm*—Antonelli, Terry, Stout & Kraus, LLP

[57] ABSTRACT

In a developing apparatus, a developing roller has a toner layer formed on a surface thereof, which toner layer is brought into contact with a photoconductor. A magnetic conveying roller having a magnet body is arranged rotatively close to the photoconductor. A regulating plate is provided at an outer periphery of the conveying roller.

36 Claims, 10 Drawing Sheets

DEVELOPING APPARATUS AND COLOR ELECTROPHOTOGRAPHIC APPARATUS USING THE SAME

BACKGROUND OF THE INVENTION

The present invention relates to a developing apparatus and a color electrophotographic apparatus using the developing apparatus, and, more particularly, the invention relates to a developing apparatus for use in an electrophotographic apparatus, such as a copying machine, a printer and a facsimile machine, and a color electrophotographic apparatus using the developing apparatus.

The present invention relates to a developing apparatus where mono-component developing is carried out in a developing process using a two-component developer comprised of toner and a carrier, and a color electrophotographic apparatus using the developing apparatus.

Two types of conventional developing apparatus have been employed, i.e. a two-component developing apparatus using a two-component developer, including a carrier and toner, and a mono-component developing apparatus using a one-component developer, including only toner. In the conventional mono-component developing apparatus, since a carrier is not used and a mixture ratio controlling mechanism for the developing apparatus is unnecessary, a compact size and a low cost developing apparatus can be obtained, and further, there is no carrier to stick to the photoconductor. This type of mono-component developing apparatus is used in a color electrophotographic apparatus where plural developing apparatuses are installed. A conventional mono-component developing apparatus using a non-magnetic type color toner in a color electrophotographic apparatus will be described with reference to FIG. 20.

In the conventional mono-component developing apparatus 321 using a non-magnetic type color toner in a color electrophotographic apparatus, as shown in FIG. 20, the developing apparatus 321 comprises a photoconductor 301, a developing roller 302 oppositely arranged with respect to the photoconductor 301, a blade member 318, a magnetic conveying roller 320, a toner hopper 306, an agitating blade 307 provided in the toner hopper 306, and a toner leakage preventing member 319.

The toner in the toner hopper 306 is supplied through an opening 313 to the vicinity of the magnetic conveying roller 320 with rotation of the agitating blade 307, and the toner is then supplied to the vicinity of the developing roller 302 by the magnetic conveying roller 320.

A toner layer 312 is formed on a surface of the developing roller 302 by the blade member 318 and is conveyed to a position which is oppositely arranged with respect to the photoconductor 301 with rotation of the developing roller 302. The toner layer 312 is moved into contact with an electrostatic latent image formed on the surface of the photoconductor 301, with the result that a toner image is formed on the photoconductor 301 by the action of the developing electric field at the developing position.

In particular, a non-magnetic mono-component developing apparatus of the type described above is disclosed in, for example, Japanese patent publication No. 43,546/1995 and Japanese utility model publication No. 20,683/1995. Further, a magnetic type mono-component developing apparatus is disclosed in, for example, Japanese patent publication No. 48,901/1990.

In the non-magnetic type mono-component developing apparatus using non-magnetic toner, there are two techniques employed where a roller having a magnet body (a magnet roll) is used as a magnetic conveying roller. One technique used in a non-magnetic type mono-component developing apparatus is disclosed in, for example, Japanese patent laid-open publication No. 77,764/1980, in which a contacting developing process is carried out on a developing roller using a sponge roller. Further, another technique used in a non-magnetic type mono-component developing apparatus is disclosed in, for example, Japanese patent laid-open publication No. 59,576/1991 and Japanese patent laid-open publication No. 239,266/1986, in which a non-contacting developing process is carried out via a gap formed between a toner layer formed on a developing roller and a photoconductor.

In the case where the conventional non-magnetic type mono-component developing apparatus is used to obtain a highly precise color picture image at a high speed or to employ a low temperature fixing for purposes of electric power saving, a filming phenomenon occurs on the developing roller due to adhesion of the toner thereon. Such a filming phenomenon due to adhesion of the toner may generate an inferior picture image quality and may shorten the useful life of the developing apparatus. Further, in the non-contacting developing method, where a gap is provided between the toner layer on the developing roller and the photoconductor, the reproducibility of a minute mesh-point picture image and the reproducibility for a gradation become insufficient.

In more detail, in a developing apparatus in which only a non-magnetic type toner is coated on the developing roller, to form a highly precise image with a high image density at a high speed, as to each element of the developing apparatus, various problems must be considered. Such problems are (1) how to achieve an improvement of the durability of the developing apparatus, and (2) how to ensure that a sufficient toner coating amount will be provided to obtain the formation of a uniform toner layer on the developing apparatus and a high image density. Further, problems to be considered are (3) how to prevent the carrier from sticking to the developing roller, (4) how to effect maintenance of the toner density of the developer which is held on the magnetic conveying roller having a magnet body, and (5) how to effect improvement of the reproducibility of a fine mesh-point pattern image and the reproducibility of a gradation pattern image.

For example, in the conventional method of carrying out contact developing using a sponge roller as the developing roller, the shape of the developing sponge roller is easily deformed, so that the life of the developing sponge roller becomes short. As a result, such a developing apparatus has a problem in that the developing roller has low durability as stated in the above problem (1).

Further, in the conventional method for carrying out non-contact development by providing a gap between the toner layer formed on the developing roller and the photoconductor, the reproducibility of a fine mesh-point pattern image and the reproducibility of a gradation-pattern image becomes insufficient. Accordingly, the developing apparatus has a problem with reproducibility of a fine mesh-point pattern image and the reproducibility of a gradation pattern image as stated in the above problem (5).

SUMMARY OF THE INVENTION

An object of the present invention is to provide a developing apparatus and a color electrophotographic apparatus using the developing apparatus, where during a developing process only non-magnetic type mono-component toners are carried on a developing roller, and wherein a filming phenomenon due to the toners, where a covering film of toners is formed on a surface the developing roller, can be prevented.

Another object of the present invention is to provide a developing apparatus and a color electrophotographic apparatus using the developing apparatus, where during a developing process only non-magnetic type mono-component toners are carried on a developing roller, and wherein a high quality developing apparatus capable of stable operation at a high speed can be obtained.

A further object of the present invention is to provide a developing apparatus and a color electrophotographic apparatus using the developing apparatus, where a low temperature fixing required to attain an electric power saving is carried out, and wherein a developing apparatus capable of use as a color electrophotographic apparatus can be obtained.

A further object of the present invention is to provide a developing apparatus and a color electrophotographic apparatus using the developing apparatus, wherein a high quality image developing process at high speed can be performed over a long period of time.

According to the present invention, in a developing apparatus in which a toner layer is formed on a surface of a developing roller, the developing roller is made to contact a photoconductor, and an electrostatic latent image formed on the photoconductor is developed by the transfer of toners.

The developing apparatus comprises a developing roller constituted by a metal sleeve and an elastic roll fitted into the metal sleeve, a magnetic conveying roller rotatively arranged at a position close to the developing roller and having a multi-magnetic pole type magnet body, and a regulating plate member for regulating the layer thickness of developer including carriers and toners.

A developer layer regulated by the regulating plate member is made to contact the developing roller by rotating the developing layer, and an electric field is applied between the magnetic conveying roller and the developing roller, thereby a toner layer is formed on the surface of the developing roller.

With the developing apparatus described above, it is preferable to provide a toner reservoir for temporally collecting the toners supplied from a toner hopper and a guiding plate member for forming an opening portion at an upper portion of the magnetic conveying roller to lead the toners at a side of the magnetic conveying roller from a lower portion of the toner reservoir.

In the above case, fresh toners can be supplied through the above opening portion at the side of the magnetic conveying roller, and further the developer for mixing with the fresh toners are flown back by the regulating plate member.

Further, the above conveying roller can be employed with a second agitating member provided at the lower portion of the magnetic conveying roller. This second agitating member can be formed by a pair of screw-augers so that the developer can be conveyed in the axial direction of the magnet body of the magnetic conveying roller.

The magnetic conveying roller has 8–64 poles and the magnetic force of the magnetic pole portion has preferably a range of 250–1000 gausses.

It is preferable to set an absolute value to the difference between a first gap, which is formed between the developing roller and the magnetic conveying roller, and a second gap, which is formed between the regulating plate member and the magnetic conveying roller, within a range of 0–0.4 mm.

Further, it is preferable to set a circumferential speed ratio between the circumferential speed of the magnetic conveying roller and the circumferential speed of developing roller within a range of 1.5–5.0.

Further, it is preferable to use a developer which is constituted by ferrite carriers having a mean particle diameter of 20–80 $\mu$m and toners having a mean particle diameter of 5–8 $\mu$m. It is preferable to use a bias voltage applied to the developing roller by superposing a direct current voltage and an alternating current voltage.

According to the present invention, in a developing apparatus, a toner reservoir for temporally collecting the toners which are supplied from a toner hopper is formed, and a guiding plate member for forming an opening portion which leads the toners at a side of the magnetic conveying roller from a lower portion of the toner reservoir is provided on an upper portion of the magnetic conveying roller.

With the developing apparatus described above, without the provision of the blade member for contacting the developing roller, the magnetic conveying roller is provided with a predetermined gap adjacent the developing roller.

Since the developer (the carriers and the toners) held on the outer periphery of the magnetic conveying roller is in contact with the developing roller, a toner layer can be formed on the surface of the developing roller.

Further, the developer layer is rotated and contacted toward the counter direction against the rotating direction of the developing roller. After the electrostatic latent image has been developed on the photoconductor, it is possible to scrape down the residual toner which remains on the developing roller, and, as a result, the generation of the filming phenomenon due to the adhesion of the toners on the surface of the developing roller can be prevented.

According to the present invention, in a developing apparatus in which a toner layer is formed on a surface of a developing roller, the developing roller is in contact with a photoconductor, and an electrostatic latent image formed on the photoconductor is developed by the toners.

The developing apparatus comprises a developing roller constituted by a metal sleeve formed by one of a non-magnetic body and a weak magnetic body and an elastic roll fitted into the metal sleeve, a magnetic conveying roller rotatively arranged at a position close to the developing apparatus and having a multi-magnetic-pole type magnet body, and a regulating plate member for regulating the layer thickness of a developer including carriers and toners.

A developer layer regulated by the regulating plate member is made to contact the developing roller by rotating the developer layer, and an electric field is applied between the magnetic conveying roller and the developing roller, thereby the toner layer is formed on the surface of the developing roller.

With the developing apparatus described above, it is preferable to provide a toner reservoir for temporarily collecting the toners supplied from the toner hopper, a developer chamber provided at a position which is on an opposite side of the developing roller for circulating the developer, and a guiding plate member for leading the toners from a lower portion of the toner reservoir.

As a result, the toners can be supplied from the toner reservoir according to the volume change of the developer in the developer chamber.

The magnetic conveying roller can be formed to have a plural number of pairs of magnetic pole portions having the same magnetic polarity. The magnetic conveying roller preferably has 8–64 poles, and a circumferential speed ratio between the circumferential speed of the magnetic conveying roller and the circumferential speed in the developing roller is set within a range of 1.5–5.0.

It is preferable to set an absolute value in a difference between a first gap, which is formed between the developing roller and the magnet body of the magnetic conveying roller, and a second gap, which is formed between the regulating plate member and the magnet body of the magnetic conveying roller, within a range of 0–0.4 mm.

Further, it is preferable to apply a bias voltage to the developing roller by superposing the direct current voltage and the alternating current voltage on a direct current voltage.

According to the present invention, in a color electrophotographic apparatus where each of plural developing apparatuses, respectively charged by a developer corresponding to a respective color, is arranged at a periphery of a respective one of plural photoconductors, each of the plural photoconductors forms an electrostatic latent image corresponding to a respective color by one or plural rotations, color toner images developed by the plural developing apparatuses are formed on the respective photoconductors, and a toner picture image having a respective is formed on a surface of each of the photoconductors.

In the color electrophotographic apparatus comprising plural developing apparatuses, at least one of the electric field and a circumferential speed ratio between the developing roller and the magnetic conveying roller is controlled in each developing apparatus in accordance with the color toner images for each color.

According to the present invention, in a developing apparatus in which a regulating plate member for regulating a layer thickness of a developer including carrier and toner is provided at an outer periphery of a magnetic conveying roller in the form of a magnet roll, a magnetic brush shaped layer of developer is formed on a surface of the magnetic conveying roller, and the developing is carried out by effecting contact between the magnetic brush shaped layer and the photoconductor.

The magnetic conveying roller is constituted by a multi-magnetic-pole magnet body in which plural pairs of magnetic poles having the same polarity portions are disposed with an equal interval and the magnet roll is rotatively arranged, so that the developing is carried out by application of an electric field between the magnetic conveying roller and the photoconductor.

According to the present invention, in a developing apparatus in which a regulating plate member for regulating a layer thickness of a developer including carrier and toner is provided at an outer periphery of a magnetic conveying roller in the form of a magnet roll, a magnetic brush shaped layer of developer is formed on a surface of the magnetic conveying roller, and the developing is carried out by transferring the toner to a photoconductor from the magnetic brush shaped layer.

A toner reservoir for collecting the toner which is supplied from a toner hopper is provided, a developer chamber is provided on the magnetic conveying roller at a side opposite the developing roller for circulating the developer, and a guiding plate member is provided for leading the toner to the developer chamber from a lower portion of the toner reservoir, thereby the toner is supplied from the toner reservoir according to the change in the volume of the developer in the developer chamber.

A guide plate member is provided at the upper portion of the magnetic conveying roller. The developer is comprised of conductive resin coated carrier particles having a mean particle diameter of 30–80 $\mu$m and the toner includes a conductive agent and has a mean particle diameter of 5–8 $\mu$m.

With the developing apparatus stated above, without the provision of a blade member for contacting the developing roller, a magnetic conveying roller having a magnet body is disposed to form a predetermined gap with the developing roller.

Accordingly, it is possible to form a toner layer on the developing roller by effecting contact between the developer (the carrier and the toner) held on the outer periphery of the magnetic conveying roller and the developing roller.

Further, by rotating the developer layer in a direction opposite the rotating direction of the developing roller, after the electrostatic latent image has been developed on the photoconductor, it is possible to scrap down the residual toner on the developing roller. As a result, the typical toner filming phenomenon does not occur on the surface of the developing roller.

Since the surface of the metal sleeve which forms the magnetic conveying roller is constituted by a non-magnetic body or a feeble magnetic body, the surface of the metal sleeve is prevented from or restrained to have magnetization. Accordingly, the problems of carrier sticking to the developing roller can be prevented.

Since the developing roller is formed by an elastic roll covered by a thin metal sleeve which can retain the elasticity property of the roll, the durability of the developing roller can be improved.

Further, in accompaniment with the toner consumption, the cubic volume of the developer in the developer chamber decreases. However, the toner from the toner reservoir is supplied to the developer chamber and mixed with the developer. As a result, the toner density of the developer can be maintained at a substantially constant level using only a mechanical construction.

According to the present invention, in a developing apparatus where a toner layer is formed on a surface of a developing roller, the developing roller is caused to contact a photoconductor, and an electrostatic latent image is formed on the photoconductor and is developed by the toner.

The developing apparatus comprises a developing roller constituted by a metal sleeve and an elastic roll fitted into the metal sleeve, a first magnetic conveying roller rotatively arranged to closely approach the developing roller and having a first magnet body, a second magnetic conveying roller rotatively arranged to closely approach the developing roller and having a second magnet body, and a distributing member provided at an intermediate position between the first magnetic conveying roller and the second magnetic conveying roller.

A distributing member is provided which distributes a developer including carrier and toner held on the first magnetic conveying roller to the second magnetic conveying roller, the developer held on the first magnetic conveying roller and the developer held on the second magnetic conveying roller contact the developing roller, and the electric fields having different directions from each other are applied between the first magnetic conveying roller and the second magnetic conveying roller and the developing roller, so that only a toner layer is formed on the surface of the developing roller.

With the above stated developing apparatus and the color electrophotographic apparatus having the developing apparatus, the filming phenomenon due to adhesion of toner on the developing roller does not occur.

According to the present invention, in a developing apparatus in which the developing is carried out by contact with a developing roller having a toner layer formed on a surface thereof, the developing roller being constituted by an elastic roll, there is provided a first magnetic conveying roller having a first magnet body and rotatively arranged close to the developing roller, and a second magnetic conveying roller having a second magnet body and rotatively arranged close to the developing roller.

A developer, which has been absorbed magnetically by the first magnetic conveying roller at a periphery of the first magnetic conveying roller, is distributed to the second magnetic conveying roller, and the toner layer is formed on the surface of the developing roller by applying a bias voltage to the first magnetic conveying roller and to the second magnetic conveying roller.

According to the present invention, in a developing apparatus in which the developing is carried out by contact with a developing roller having a toner layer formed on a surface thereof, there is provided a first magnetic conveying roller constituted by a metal sleeve and an elastic roll fitted into the metal sleeve, a first magnetic conveying roller having a first magnet body and rotatively arranged close to the developing roller, and a second magnetic conveying roller having a second magnet body and rotatively arranged close to the developing roller.

In a regulating plate member for regulating a developer which has been absorbed magnetically by the first magnet body of the first magnetic conveying roller at a periphery of the first magnetic conveying roller, a relationship, among a gap (Go) formed between the first magnetic conveying roller and the regulating plate member, a first roller gap (G1) formed between the first magnetic conveying roller and the developing roller, and a second roller gap (G2) formed between the second magnetic conveying roller and the developing roller, is satisfied by a first formula (1) and a second formula (2), the developer absorbed by the first magnetic conveying roller being distributed to the second magnetic conveying roller, and the toner layer being formed on the developing roller by application of a bias voltage to the first magnetic conveying roller and the second magnetic conveying roller, wherein the formula (1) and the formula (2) are:

$$G1<Go \quad (1)$$

$$G2 \leqq Go-G1 \quad (2)$$

With the above stated developing apparatus and the color electrophotographic apparatus having the developing apparatus, the typical filming phenomenon due to the toner does not occur on the developing roller.

DESCRIPTION OF THE INVENTION

Hereinafter, one embodiment of a developing apparatus according to the present invention will be explained with reference to FIG. 1.

Figure 1:
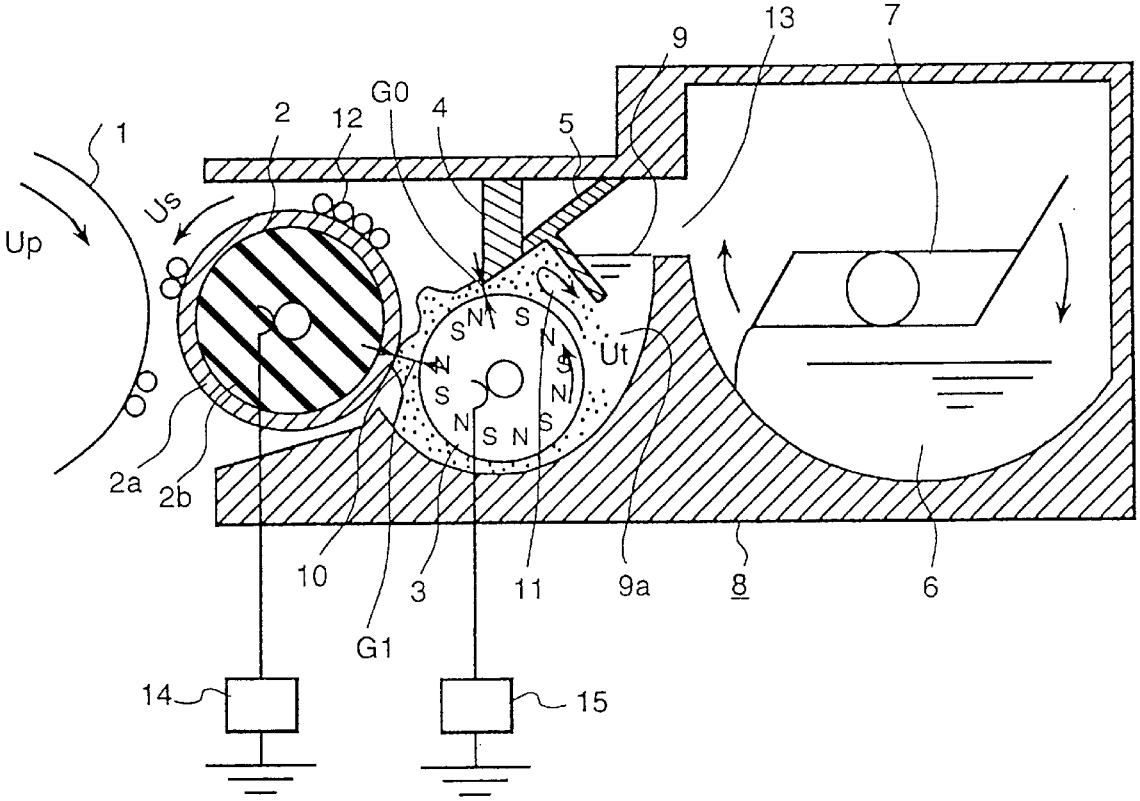
FIG. 1 is a cross-sectional view of one embodiment of a developing apparatus according to the present invention.

In FIG. 1, a developing apparatus 8 comprises a photoconductor 1, a developing roller 2 oppositely arranged with respect to the photoconductor 1, a magnetic conveying roller 3, a regulating plate 4, a toner hopper 6, and a rotatable agitating blade 7 installed in an interior portion of the toner hopper 6. The developing apparatus 8 further comprises a bias power supply 14 for applying a bias voltage to the developing roller 2, a bias power supply 15 for applying a bias voltage to the magnetic conveying roller 3, and a developer guiding plate 5. The developing roller 2 is formed to have an elasticity property by fitting a rubber roll 2*b* having a low hardness (for example, a rubber hardness of about 15°–35° (JIS-A)) into a Ni electrocast sleeve 2*a* having an outer diameter of about 20–60 μm. The Ni electrocast sleeve 2*a* of the developing roller 2 prevents damage to and abrasion of the developing roller 2, and this metal sleeve 2*a* is formed to be sufficiently thin to retain the elasticity of the rubber roll 2*b* of the developing roller 2. Therefore, even in a case where the developing roller 2 contacts the photoconductor 1, it is possible to obtain a soft contact between the developing roller 2 and the photoconductor 1. Accordingly, even when the printing speed is high, or the circumferential speed ratio k between the developing roller 2 and the photoconductor 1 is large (k—1.5–2.0), it is possible to lengthen the life of the developing roller 2 and the photoconductor 1. In this case, the developing roller 2 has an outer diameter of 15–40 mm.

As the rubber roll 2*b* of the developing roller 2, either an insulating type roll or a conductive type roll can be employed. In the case of an insulating type roll (for example, having a resistance value of about $10^{13}$–$10^{16}$ Ωcm), the electric power supply 14 for the developing bias applies a bias voltage to the surface of the developing roller 2. However, in the case of the conductive type roll (for example, having a resistance value of about $10^{7}$–$10^{8}$ Ωcm), the electric bias voltage is applied to the shaft of the developing roller 2, as shown in FIG. 1.

Further, in case the printing speed is comparatively low, or the circumferential speed of the developing roller 2 and the photoconductor 1 are substantially same, the use of the metal sleeve on the developing roller 2 becomes unnecessary, making it is possible to use only a rubber roll having a low hardness (for example, a rubber hardness of about 15°–55° (JIS-A)) in a single form or a surface coating form.

The magnetic conveying roller 3 is constituted by an equal interval multi-pole magnetic body which is arranged to form a gap (a first roller gap) G1 with the developing roller 2. The regulating plate member 4 is provided in the vicinity of the outer periphery of the magnet body of the magnetic conveying roller 3 and is set so as to produce a gap Go with the outer periphery of the magnet body of the magnetic conveying roller 3. The regulating plate member 4 regulates the thickness of a developer layer 10, including the a carrier and the toner, which is held on the surface of the magnet body of the magnetic conveying roller 3.

A developer layer 10, regulated by the regulating plate member 4, is rotated in a direction opposite to the direction of rotation of the developing roller 2, so that the developer layer 10 is brought into contact with the developing roller 2. Due to the electromagnetic field applied between the magnetic conveying roller 3 (the magnet body), as stated above, a toner layer 12 is formed on the developing roller 2. Further, it is desirable to form the electromagnetic field by superposing an alternating current of 1–10 KHz on a direct current between the magnet body of the magnetic conveying roller 3 and the developing roller 2.

The magnet body of the magnetic conveying roller 3 is constituted by only a single magnetized magnet roller having 8–64 magnetic poles and a magnetic force of 250–1000 gausses. Preferably, the magnetic body has more than 32 poles and the magnetic force of the magnetic pole portion is 350–800 gausses.

The magnet body of the magnetic conveying roller 3 conveys the magnetized developer 11, which is attracted by the magnetic force of the magnet body of the magnetic conveying roller 3. The developer layer 10 is rotated into contact with the developing roller 2 while moving in a direction counter to the rotating direction of the developing roller 2. Namely, as shown in FIG. 1, both the magnetic conveying roller (the magnet body) 3 and the developing roller 2 rotate in the counter-clockwise direction and the ratio (Ut/Us) between the circumferential speed Ut of the magnetic conveying roller (the magnet body) 3 and the circumferential speed Us of the developing roller 2 is set within a range of 1.0–5.0, preferably in a range of 2.0–4.0.

In the above stated developing apparatus 8 comprising the developing roller 2 and the magnetic conveying roller 3, the toner in the toner hopper 6 is supplied through an opening 13 to the vicinity of the upper portion of the magnetic conveying roller 3 by the agitating blade 7. The developer guiding plate 5 is provided at the upper portion of the magnetic conveying roller 3 and regulates the movement of the toner which is guided toward an area at the side of the magnetic conveying roller 3 from the opening 13. The developer guiding plate 5 forms a toner reservoir 9 at a lower portion starting from a portion extending from the developer guiding plate 5 and controls the direction of movement of the toner. The toner is transferred to the lower portion of the toner reservoir 9, in other words, the toner is transferred from an opening 9*a* at the lower end of the developer guiding plate 5 to the side of the magnetic conveying roller 3.

Further, the regulating plate 4 communicates with the developer guiding plate 5 and is provided on a downstream side of the magnetic conveying roller 3 in the rotating direction. Further, the regulating plate 4 is positioned at the upper portion of the magnetic conveying roller 3 so as to regulate the layer thickness of the developer layer 10 which is held on the surface of the magnetic conveying roller 3.

With the above stated developing apparatus construction, the toner pushed into the toner reservoir 9 by the agitating blade 7 is mixed with the circulating developer 11, which is turned back by the regulating plate 4. The developer 11, including the magnetic carrier and the non-magnetic toner held by the magnetic conveying roller 3, can move in the direction of the regulating plate 4. The developer 11 which is not blocked by the regulating plate 4 can move toward the surface of the developing roller 2, where the blocked developer 11 returns to the lower portion of the toner reservoir 9 along the guiding surface of the developer guiding plate 5. The above stated developer moving process is continuously carried out.

The developer 11 passed by the regulating plate 4 is formed to a predetermined thickness on the surface of the roller 3 and is moved toward the surface of the developing roller 2. The layer of developer 11 is moved by rotating the magnetic conveying roller 3 in a direction counter to the rotating direction of the developing roller 2. By the action of the electric field between the magnetic conveying roller 3 and the developing roller 2, the toner is transferred toward the developing roller 2 so that a toner layer 12 is formed on the surface of the developing roller 2. This toner layer 12 is formed to have a toner electric charging amount of 5–30 μC/g, preferably 7–20 μC/g, and to have the toner coating amount of 0.4–1.5 mg/cm$^2$, preferably 0.6–1.2 mg/cm$^2$.

Next, the toner layer 12 is conveyed to a position opposite to and in contact with the photoconductor 1 by the rotation of the developing roller 2 and is brought into contact with an electrostatic latent image formed on the surface of the photoconductor 1. By the action of the developing electric field applied to the developing portion, the toner adheres to the electrostatic latent image so that the electrostatic latent image becomes an apparent image, with the result that a toner image is formed on the surface of the photoconductor 1.

As stated above, the developer (a magnetic brush) 11 is absorbed and conveyed by the magnetic conveying roller 3 having a magnet body. As stated above, the developer 11 comprises the toner and a carrier and moves with the agitation operation and the conveying operation such that the toner and carrier are charged with a reverse polarity with respect to each other according to a frictional electrification. Under this condition, an electric field of predetermined direction (an order direction electric field) is applied between the magnetic conveying roller 3 and the developing roller 2. As a result, the toner is separated from the carrier in the developer 11, so that the toner is held on the magnet body of the magnetic conveying roller 3 and can move toward the developing roller 2, with the result that a substantially uniform toner layer 12 can be formed on the surface of the developing roller 2. After that, the toner layer 12 formed on the surface of the developing roller 2 contacts the electrostatic latent image on the surface of the photoconductor 1 and a toner transfer takes place, whereby the developing process is carried out.

Namely, in this first embodiment of the developing apparatus 8 according to the present invention, it is unnecessary to provide a blade member in contact with the developing roller 2 to from a substantially uniform and thick toner layer 12 thereon. Further, since the developing process is carried out using the toner layer 12, the filming phenomenon typical in the use of toners does not occur on the surface of the developing roller 2.

In the developing apparatus 8 of the first embodiment according to the present invention, as stated in later, the developing apparatus 8 has a controlling unit for controlling the rotation speed and the bias voltage of the magnetic conveying roller 3. Accordingly, it is possible to change the rotation speed of the magnetic conveying roller 3. By adjusting the bias voltage of the magnetic conveying roller 3 and by adjusting the electric field strength applied between the magnetic conveying roller 3 and the developing roller 2, the thickness of the toner layer 12 which adheres to the developing roller 2 can be adjusted. As a result, the stability of the image density of the developing apparatus 8 can be improved, and further the image quality of the color picture image of the developing apparatus 8 can be maintained at a constant level during a long period time.

The developing roller 2 and the photoconductor 1 can be set to rotate in the same direction or in opposite directions. The circumferential speed ratio k (=Us/Up) of the developing roller 2 and the photoconductor 1 is set to less than 2. The circumferential speed ratio k is preferably set with a range of $1 \leqq k \leqq 1.5$ and the difference $\Delta V$ (=Up−Us) in speed is preferably set within a range of $0 \leqq \Delta V \leqq 50$ mm.

In particular, with the above-mentioned developing apparatus construction, since an alternating voltage of 1–10 KHz and 100–1000 V is superposed as the bias voltage, both the uniformity of the picture image and the abrasion prevention characteristics of the photoconductor 1 can be made compatible.

The magnetic conveying roller (magnet body) 3 may be formed by arranging a magnet roll with a sleeve concentrically and rotatively provided on the magnet roll. In this case, the magnetized magnet roll is 8–24 magnetic poles and a magnetic force at the magnetic pole portion of 400–1000 gausses.

To cause the developer layer 10 to move against the developing roller 2 by rotating it in a direction opposite the rotating direction of the developing roller 2, the magnetic conveying roller 3 is rotated in the clockwise direction and the sleeve 2*a* of the developing roller 2 is rotated in the counter-clockwise direction. In this case, the ratio between the circumferential speed of the sleeve 2*a* of the developing roller 2 and the circumferential speed Us of the developing roller 2 is set within a range of 1.0–3.0, preferably 1.2–2.0. Further, the rotational speed of the magnetic conveying roller 3 is set within a range of 1.5–4.0 of the rotational speed of the sleeve 2*a*.

In this first embodiment of the developing apparatus 8 according to the present invention, the first gap G1 formed between the developing roller 2 and the magnetic conveying roller (the magnet body) 3 is set within a range of 0.5–1.0 mm. An absolute value |G1−Go| representing the difference between the first gap G1 and the gap Go formed between the regulating plate member 4 and the magnetic conveying roller (the magnet body) 3 is set within a range of 0–0.4 mm.

Further, the bias power supplies 14 and 15 are respectively connected to the developing roller 2 and the magnetic conveying roller (the magnet body) 3, and a direct current voltage, or a direct current voltage superposed on an alternating current voltage, is applied respectively to the developing roller 2 and the magnetic conveying roller 3. In a case where the resistance value of the magnetic conveying roller (the magnet body) 3 is high, the regulating plate member 4 is formed of conductive material, and a bias voltage is applied to the regulating plate member 4 from the bias power supply 15. Accordingly, the lowering of the electric field strength in the first gap GI can be prevented.

As the developer 11 held on the magnetic conveying roller 3, a developer including a carrier having a mean particle diameter of 20–100 μm (preferably 40–80 μm) and toner having a mean particle diameter of 5–8 μm is employed. However, to scrape down the residual toner which remains on the surface of the developing roller 2 after an electrostatic latent image has been developed on the surface of the photoconductor 1, it is most desirable to employ ferrite powder carriers having a mean particle diameter of 20–80 μm. However, by increasing the magnetic force and the circumferential speed of the magnetic conveying roller (the magnet body) 3, resin carriers and ferrite carriers can be employed in place of the above-mentioned ferrite powder carriers. As resin carriers, one may use sphere shaped carrier or indefinite shaped carrier having an apparent density of 1.0–1.6 g/cm$^3$ and a saturation magnetization of 60–80 emu/g. As a ferrite carrier, one may use substantially sphere shaped carrier having an apparent density of 2.2–2.7 g/cm$^3$ and a saturation magnetization of 20–70 emu/g.

To perform a lower temperature fixing process, the toner is used with a binder resin having a glass transaction temperature Tg of 55°–65° C. To improve the fluidity property of the toner, one or two kinds of silica having a mean particle diameter of 10–100 nm or a non-organic oxide material may be used together. As the developer 11, a mixture having a density of 5–20 wt. % may be used. Further, as stated above, the developer guiding plate 5 is provided at the upper portion of the magnetic conveying roller 3 so that a toner reservoir 9 is formed thereby. The developer 11, which is regulated by the regulating plate 4, is turned back in a U-shape direction and is directed to flow into the lower portion of the reservoir. As a result, a good time lapse stability property of the image, such as the image density and the fogging by the toner etc., can be obtained.

The above-described developing apparatus 8 may be applied to a color electrophotographic printer system, and further a positively charged organic photoconductor (OPC) may be used as the photoconductor 1. A electrostatic latent image having a contrast voltage of about 450 V is formed on the surface of the photoconductor 1 having a circumferential speed of 100–400 mm/sec. The circumferential speed Us of the developing roller 2 is set to about 1–2 times that of the circumferential speed Up of the photoconductor 1. A developing bias voltage of 250–350 V is applied to the developing roller 2 and positively charged toners are used.

In a color electrophotographic printer system having the above stated construction and conditions, a reversal development is performed, and, as a result, an image density of 1.3–1.4 (O.D (optical density)) can be secured. Further, even in the case of printing over a long period of time, the filming phenomenon due to the toner carried on the developing roller 2 does not appear. An example of a color electrophotographic printer system using the developing apparatus according to the present invention will be explained with reference to FIG. 15. In this example, the developing apparatus of FIG. 1 is applied to a color electrophotographic printer system having four image forming units corresponding to respective colors.

The developing apparatus according to the present invention can be employed as any one or all of the four developing apparatuses 208*a*, 208*b*, 208*c* and 208*d*. Thus, as shown in FIG. 15, only the developing apparatus 208*a* according to the present invention will be explained in detail.

Four developing apparatuses 208*a*, 208*b*, 208*c* and 208*d*, each of which accommodates the developer corresponding to a respective color, are arranged in operative association with a respective one of plural photoconductors 201*a*, 201*b*, 201*c*and 201*d*. A respective one of the plural photoconductors 201*a*, 201*b*, 201*c* and 201*d* is uniformly charged according to a respective one of plural chargers 223*a*, 223*b*, 223*c* and 223*d*. Under consideration of the transfer timing of an image to a paper sheet 222, the transfer timing of the latent image using the exposing lights 224*a*, 224*b*, 224*c* and 224*d* is determined. A latent image corresponding to each color is formed on a respective one of the photoconductors 201*a*, 201*b*, 201*c* and 201*d*. The color overlapping process causes each toner image to be transferred successively onto the paper sheet 222 using the respective transferring means 225*a*, 225*b*, 225*c* and 225*d*.

Hereinafter, one example of the developing apparatus 208*a*, in which the developing apparatus 8 of FIG. 1 is employed, will be explained.

Figure 15:
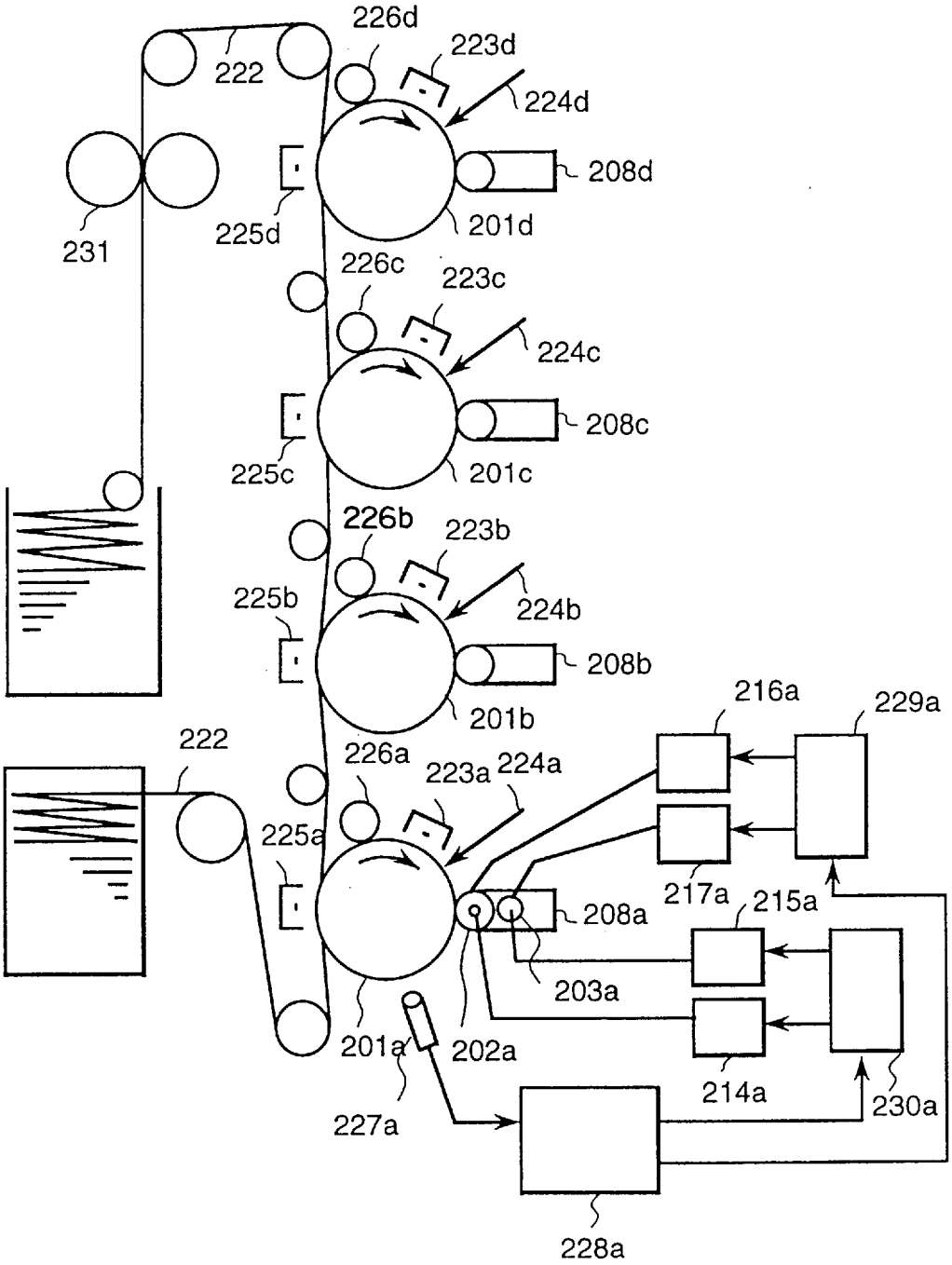
FIG. 15 is a schematic diagram of one example of a color electrophotographic printer system using a developing apparatus according to the present invention.

As understood from the color electrophotographic printer system shown in FIG. 15, bias power supplies 214*a* and 215*a* are connected to a developing roller 202*a* and a magnetic conveying roller 203*a* , respectively. The developing roller 202*a* and the magnetic conveying roller 203*a* are rotatively driven by the rotation driving units 216*a* and 217*a*, respectively. A color picture image detecting sensor 227*a* for detecting the developed color toner image is oppositely arranged with respect to the outer peripheral face of the photoconductor 201*a*, and the detected output of the color picture image detecting sensor 227*a* is input to a picture image controlling unit 228*a*. The above stated power supplies 214*a* and 215*a* are controlled by a bias controlling unit 230*a*. This bias controlling unit 230*a* can set the required bias voltage and the bias frequency in response to the controlling output from the picture image controlling unit 228*a*. The rotating speeds of the rotation driving units 216*a* and 217*a* are controlled by a rotation controlling unit 229*a*. The rotation controlling unit 229*a* also can set the speed in response to the controlling output from the picture image controlling unit 228*a*.

Further, at the peripheral portion of each of the photoconductors 201*a*, 201*b*, 202*c* and 201*c*, respective cleaners 226*a*, 226*b*, 226*c* and 226*d* are arranged to clean the residual toner on the photoconductors 201*a*, 201*b*, 201*c* and 201*d* after the transfer processing by the transferring means 225*a*, 225*b*, 225*c* and 225*d* is completed. A fixing means 231 for heat-fusing and fixing a non-fixed picture image to the paper sheet 222 is installed downstream of the last stage transferring means 225*d*.

In this color electrophotographic printer system having a developing apparatus according to the present invention, a color picture image is continuously formed using a special fan fold paper sheet. However, the color picture image also can be continuously formed on single or plain paper sheets. Further, for example, even when a two-color picture image is to be formed, by the provision of two stages of photoconductors and developing apparatuses providing a two-color image, the color electrophotographic apparatus will be constituted with a similar construction to that stated above.

In this color electrophotographic printer system, the developing apparatuses 208*b*, 208*c* and 208*d* will carry out a similar operation to that stated above.

Figure 9:
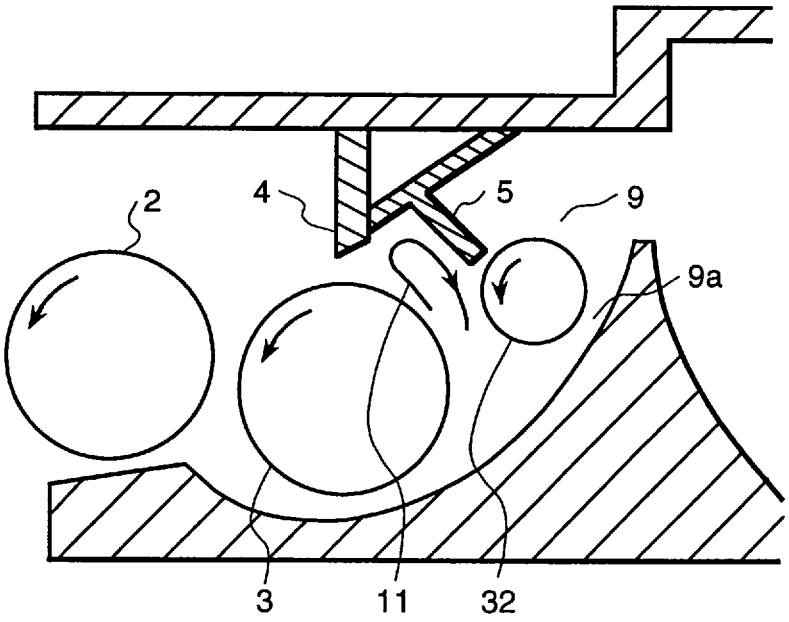
FIG. 9 is a cross-sectional view of another embodiment of a developing apparatus according to the present invention.

FIG. 9 is a diagram showing a second embodiment of a developing apparatus according to the present invention. In FIG. 9, the same elements shown in FIG. 1 are represented by the same reference numerals, and a detailed explanation thereof will be omitted. According to this second embodiment of the developing apparatus according to the present invention, as understood from FIG. 9, a second magnetic conveying roller 32 additionally is provided at the opening portion 9*a* between the magnetic conveying roller 3 and the toner reservoir 9 in the developing apparatus 8 of FIG. 1.

In this embodiment, the second magnetic conveying roller 32 comprises a sponge roll member or a rotary brush member. The second magnetic conveying roller 32 is in contact with or positioned closely adjacent to the developer guiding plate member 5. By provision of the second magnetic conveying roller 32, the toner layer 12, including fresh toner from the toner reservoir 9, is formed on the second magnetic conveying roller 32. The second magnetic conveying roller 32 contacts the developer 11, which is regulated by the regulating plate member 5 so that some of it flows back, as shown by the arrow in FIG. 9, while a controlled layer of the developer 11 is retained on and moved by the magnetic conveying roller 3 toward the developing roller 2.

With this second embodiment of the developing apparatus as described above, in comparison with the first embodiment, the fogging by the toners can be further reduced.

Figure 10:
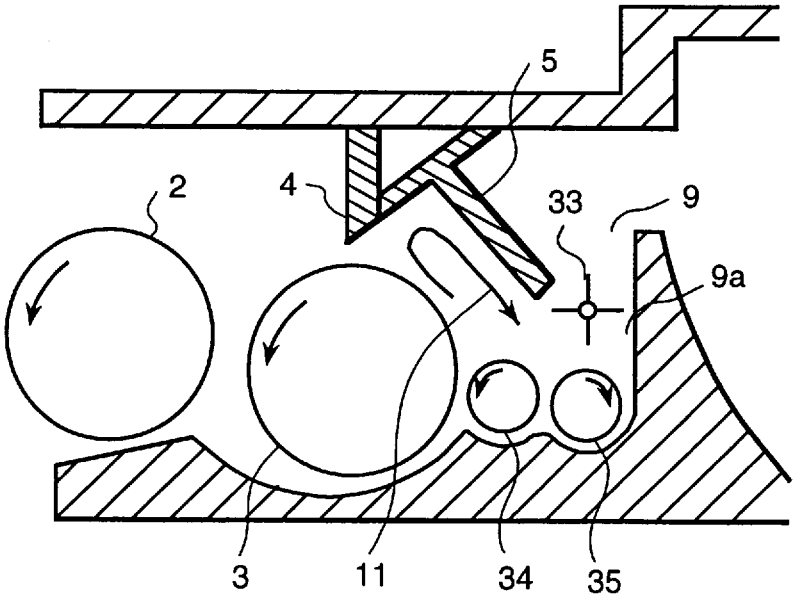
FIG. 10 is a cross-sectional view of a further embodiment of a developing apparatus according to the present invention.

FIG. 10 is a diagram showing a third embodiment of a developing apparatus according to the present invention. In FIG. 10, the elements shown in the first embodiment and the second embodiment are represented by the same reference numerals, and a detailed explanation thereof will be omitted. In this third embodiment, in place of the second magnetic conveying roller 32 shown in the second embodiment, the developing apparatus has a second agitating member 33. Using this second agitating member 33, the toner in the toner reservoir 9 is mixed with the developer 11. As the second agitating member 33, an agitating blade or a screw auger can be employed.

With the embodiment of the developing apparatus as described above, during a long period of printing, an unevenness in the image density does not occur, and further the fogging by the toner can be reduced.

As shown in FIG. 10, in addition to the second agitating member 33, two agitating members 34 and 35 are provided at a lower portion below the second agitating member 33. As to the two agitating members 34 and 35, in this case two screw augers having different axial conveying directions are employed. It is preferable to arrange these two agitating members 34 and 35 to agitate in the rotating direction and the ability to move the developer 11 in a parallel direction against the rotating direction of the magnetic conveying roller 3. More specifically, the agitating member 34 or 35 can be formed with a screw shape or have an inclined fan shape, and by reversing the rotating direction of the agitating member 34 or 35, the direction of direction of the developer 11 may be changed.

With this third embodiment of the developing apparatus as described above, during a long period of printing, an unevenness in the image density in the axial direction does not occur, and further the fogging by the toner can be reduced even more in comparison with the provision of only the second agitating member 33.

According to the above stated embodiments of the present invention, even the case of a long period of printing using a low temperature fixing toner, the typical toner filming phenomenon does not occur on the developing roller, and so a developing apparatus producing a high quality image can be obtained. In a high speed color electrophotographic printer system using the developing apparatus according the present invention, since a fluctuation in the image density can be prevented, a clear and stable color picture image can be secured.

Various examples of constructions of a developing roller 2 and a magnetic conveying roller 3 as used in the developing apparatus of the present invention will now be explained.

In the developing apparatus of the present invention, one example of a developing roller comprises a metal sleeve and a rubber roll member which is fitted into the metal sleeve. The metal sleeve has a thickness of about 20–60 $\mu$m and the surface of the metal sleeve is formed by a nonmagnetic body or a feeble magnetic body. The rubber roll member has a low hardness, for example, a rubber hardness of about 15°–35° (JIS-A). This developing roller has an elasticity property. As a material for the metal sleeve, both a nonmagnetic material and a two-layer material can be employed. The metal sleeve of the developing roller will be explained in more detail with reference to FIG. 2 and FIG. 3.

Figure 2:
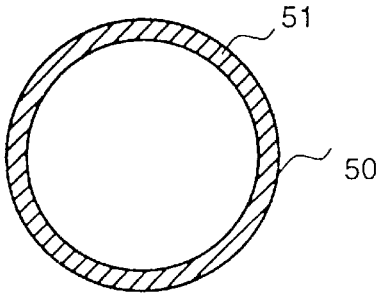
FIG. 2 is a cross-sectional view showing one example of a metal sleeve for constituting a developing roller of a developing apparatus according to the present invention.
Figure 3:
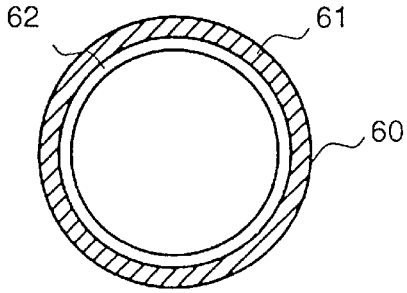
FIG. 3 is a cross-sectional view showing another example of a metal sleeve for constituting a developing roller of a developing apparatus according to the present invention.

In the case of a non-magnetic body, such as a body made of SUS, copper alloy metal, Al, Ni etc., as shown in FIG. 2, a single layer metal sleeve 50 can be employed. The single layer metal sleeve 50 comprises a surface layer 51 having a magnetic body. However, in the case of a magnetic body 62, such as a body made of Ni, SUS etc., as shown in FIG. 3, it is desirable to employ a two-layer metal sleeve 60 having a surface layer 61. The surface layer 61 comprises a non-magnetic body or a feeble magnetic body.

As the surface layer 61, for example, one of a rubber material, a resin coating material, a resin tube material, a metal coating material (metal powers coated with a resin material as a binder) of a non-magnetic body or a feeble magnetic body, or a metal soldering material of a non-magnetic body or a feeble magnetic body is employed.

Herein, to provide a comparison with a developing roller having a magnetic body, a Ni (single layer) electrocast sleeve and a magnetic conveying roller having 8–32 magnetic poles and having a peak magnetic force of 400–800 gausses were used. The first roller gap G1 formed between the developing roller and the magnetic conveying roller was set to a range of 0.5–1.2 mm. As the magnetic body carrier, a ferrite carrier or magnetite carrier having a saturation magnetization of 50–100 emu/g and a mean particle diameter of 30–100 $\mu$m was used. The developer including the above ferrite carrier or the above magnetite carrier was prepared to have a toner density of 5–20%. As a result of the experiment, it was found that the Ni electrocast sleeve of the developing roller was magnetized and the carrier adhered to the developing roller.

As a more specific example of the two-layer metal sleeve 60 shown in FIG. 3, there is (1) a two-layer type metal sleeve 60 in which the surface layer 61 of the magnetic type Ni electrocast sleeve 62 is coated by a fluorine system resin having a thickness of 5–20 $\mu$m, or (2) a two layer type metal sleeve 60 in which the surface layer 61 of the magnetic type Ni electrocast sleeve 62 is coated by an Al layer having a thickness of 10–30 $\mu$m. With the use of these two kinds metal sleeves 60, the adhesion of the toner to the developing roller can be prevented. In this case, the developing roller is one having an outer diameter of 15–40 mm.

With the above stated metal sleeve 60, the surface of the magnetic type Ni electrocast sleeve 62 was covered by a non-magnetic body or the feeble magnetic body. Therefore, through the magnetic type carrier absorbed to the magnetic conveying roller, the magnetization of the surface of the magnetic type Ni electrocast sleeve 62 was prevented or reduced by the magnetic field of the magnet body of the magnetic conveying roller. As a result, the adhesion of the carrier to the surface of the magnetic type metal sleeve 60, namely the adhesion of the carrier to the developing roller, could be prevented.

As examples of the rubber or the resin to be coated on the roller, there are a fluorine system resin, a silicon system resin, a fluorine rubber or those of the above stated members to which a conductive agent has been added. As to the tube type member, a silicon rubber tube, a nylon tube or these elements to which a conductive agent has been added, may be employed.

As the metal coating agent, it is desirable to employ powder material of SUS304, SUS305, or SUS306 or a thin film powder material with a binder material such as polyurethane, epoxy, vinyl chloride, silicone or acrylic resin. As to the metallic soldering, in addition to a magnetic type metal such as Cr, a soft feeble magnetic type metal, such as Ni, can be employed.

Next, examples of a magnetic conveying roller according to the present invention will be explained with reference to FIG. 4, FIG. 5 and FIG. 6.

Figure 4:
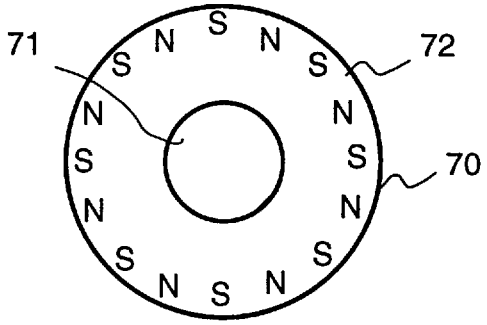
FIG. 4 is a cross-sectional view showing one example of a sleeveless magnetic conveying roller of a developing apparatus according to the present invention.
Figure 5:
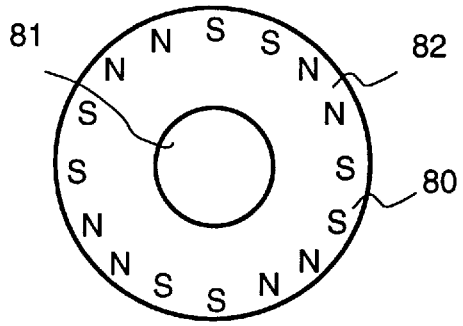
FIG. 5 is a cross-sectional view showing another example of a sleeveless magnetic conveying roller of a developing apparatus according to the present invention.
Figure 6:
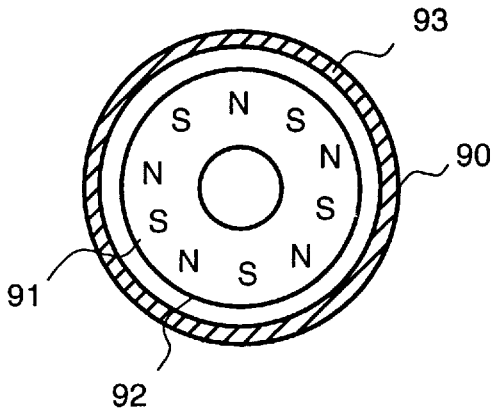
FIG. 6 is a cross-sectional view showing one example of a magnetic conveying roller having a rotating sleeve of a developing apparatus according to the present invention.

As the magnet body for constituting the magnetic conveying roller, as shown in FIG. 4 and FIG. 5, a single magnet roll 72 of a sleeveless magnetic conveying roller 70 having a roller shaft 71, or a single magnet roll 82 of a sleeveless magnetic conveying roller 80 having a roller shaft 81, can be employed. Further, as shown in FIG. 6, as a magnet body of the magnetic conveying roller, a magnetic conveying roller 90 having a sleeve 93 which is concentricity arranged on a magnet roll 92 and a rubber sponge roll 91 can be employed.

First of all, the use of the sleeveless magnetic conveying roller 70 or 80 will be explained. In this case, the first roller gap G1 formed between the developing roller and the magnetic conveying roller is set within a range of 0.5–1.2 mm, and the second roller gap G2 formed between the regulating plate member and the magnetic conveying roller is set with substantially the same range or a larger range (a difference between the second roller gap G2 and the first roller gap G1 is 0–0.4 mm) than the first roller gap G1.

FIG. 4 shows a first example wherein the magnetic conveying roller 70 has N poles and S poles which are magnetized alternatively with an equal interval to form the sleeveless magnetic conveying roller 70. In this case, the number of magnetic poles is 8–64 poles and the magnetic force in the magnetization portion is 250–1000 gausses, and preferably, the number of magnetic poles is 10–40 poles. In a case where the number of magnetic poles is less than 10 poles, since a stripe-shaped unevenness is produced on the surface of the developing roller, the toner layer becomes non-uniform. Further, the case where the number of magnetic poles is more than 40 poles, the lowering of the magnetic force in the magnetic pole portion becomes remarkable.

In the magnetic conveying roller 70, the developer which is absorbed by the magnetic force produced by the magnet body 72 forms a magnetic brush shaped layer (the developer layer) and the developer rotates and contacts the developing roller, thereby causing the toners to be coated on the surface of the developing roller. In accompaniment with the rotation and the movement of the magnetic poles, the crests and troughs of the magnetic brush shaped layer is removed continuously. In a case where the number of magnetic poles is small and the circumferential speed K2 of the magnet body 72 of the magnetic conveying roller 70 (=Ut/Us) is small, a stripe-shaped unevenness is produced on the surface of the developing roller, and the non-uniform quality of the toner layer becomes remarkable.

Accordingly, the circumferential speed Ut of the magnet body 72 of the magnetic conveying roller 70 is set within a range of 1.3–5.0 times the circumferential speed Us, and preferably within a range of 2.0–4.0. As a result, the stripe-shaped unevenness on the surface of the developing roller can be prevented and the image density can be made substantially uniform.

FIG. 5 is an example of a sleeveless magnetic conveying roller 80 on which plural magnet bodies comprising pairs of magnet bodies having the same polarity are arranged, so that the magnet body 82 is magnetized with N, N, S, S, . . . In this example of the sleeveless magnetic conveying roller 80, the number of magnetic poles is preferably set within a range of 16–32 poles, the magnetic force in the magnetization pole portion is preferably set with a range of 350–800 gausses and the difference between the force in the magnetization pole portion and the magnetic force of the same magnetization pole is set within a range of 50–200 gausses.

Figure 7:
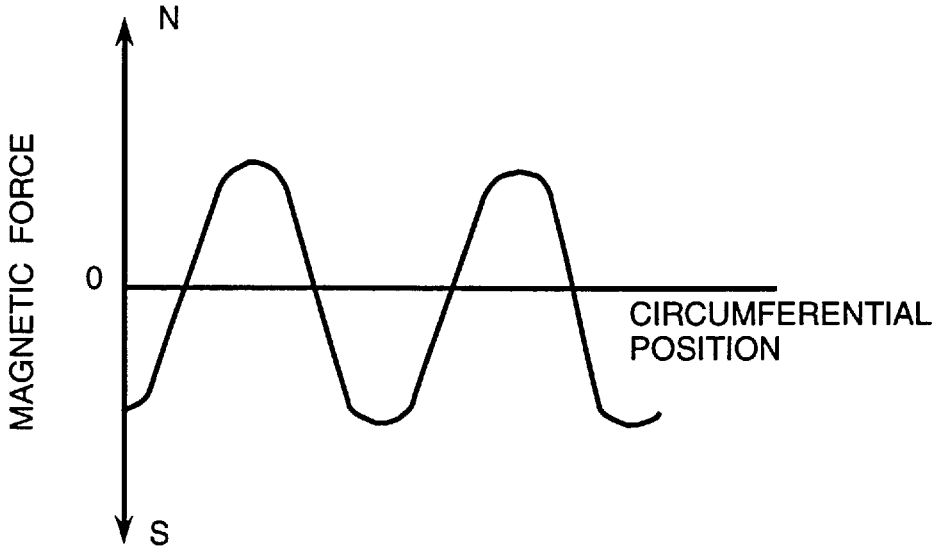
FIG. 7 is a graph showing a surface magnetic force distribution of a single polarity alternating magnetization type sleeveless magnetic conveying roller of a developing apparatus according to the present invention.
Figure 8:
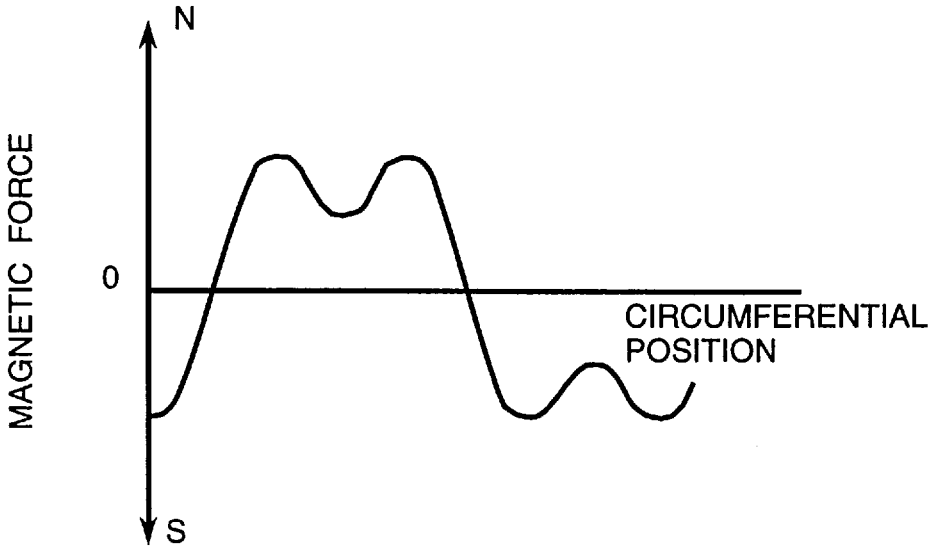
FIG. 8 is a graph showing a surface magnetic force distribution of the same polarity double pole alternating magnetization type sleeveless magnetic conveying roller of a developing apparatus according to the present invention.

In this example of the sleeveless magnetic conveying roller 80, in comparison with the example of FIG. 4 having the same number of magnetic poles, the amount of toner which adheres on the surface of the developing roller was increased, and also the stripe-shaped unevenness on the surface of the developing roller was reduced. This is due in part to the difference in the magnetic force distribution on the surface of the magnet body 72 and 82 of the magnetic conveying roller 70 and 80. Namely, as shown in FIG. 7 (relating to the example of the magnet body 70 of the magnetic conveying roller) and as shown FIG. 8 (relating to the example of the magnet body of the magnetic conveying roller), the magnetic force distribution on the surface of the magnet body 72 of the magnetic conveying roller 70 respectively differs from that of in the second magnet body 82 of the magnetic conveying roller 80.

In the example of the sleeveless magnetic conveying roller 80 (FIG. 8), comparing with the example of the sleeveless magnetic conveying roller 70 (FIG. 9), the high magnetic force portion corresponding to the crest of the magnetic brush shaped layer is widened. Namely, in the case of the sleeveless magnetic conveying roller 80, the rate of filling in of the crest portion having a good adhesion property is widened. In other words, in the case of the sleeveless magnetic conveying roller 80, the width of the crest is widened and so the number of the trough portions is reduced.

Further, as the material for the magnet body 72 or 82 of the magnetic conveying roller 70 or 80, a ferrite system material is usually employed, and so the resistance value becomes high. In this case, the conduction between the roller shaft 71 or 81 and the magnet body 72 or 82 of the magnetic conveying roller 70 or 80 is good, and to further lower the resistance value between the roller shaft 71 or 81 and the surface of the magnet body 72 or 82 of the magnetic conveying roller 70 or 80, an adhesion agent having a good conductivity is employed.

Figure 13:
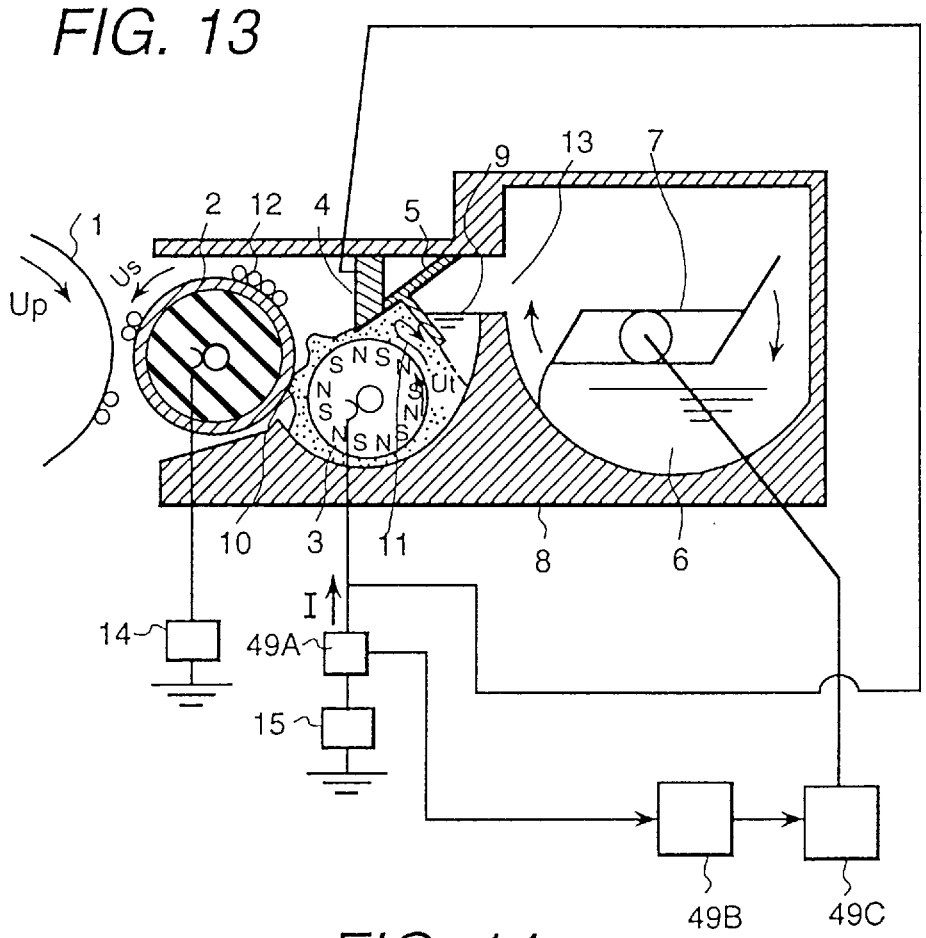
FIG. 13 is a partial cross-sectional view showing a toner supply controlling system of a developing apparatus according to the present invention.

Conductive members are arranged at both ends of the magnet body 72 or 82 of the magnetic conveying roller 70 or 80, and a bias voltage is applied from the roller shaft 71 or 81. Further, the resistance value of the developer is made lower when, as shown in FIG. 13, a bias voltage is applied to the regulating plate 4. As a result, the lowering of the electric field strength at the first roller gap G1 formed between the developing roller and the magnetic conveying roller (the magnet body) 70 or 80 can be prevented.

Further, the surface of the magnet body 72 or 82 of the magnetic conveying roller 70 or 80 may be coated with a conductive non-magnetic member, for example, the material used in the surface of the above stated metal sleeve of the developing roller, so that conduction between the roller shaft 71 or 81 and the conductive non-magnetic member may be facilitated.

In these examples, the cost for the magnetic conveying roller 70 or 80 may be increased, but if the bias voltage is merely applied from the roller shaft 71 or 81, the application of a bias voltage to the regulating plate member becomes unnecessary.

Next, the toner supply system of the developing apparatus according to the present invention will be explained in more detail.

Figure 11:
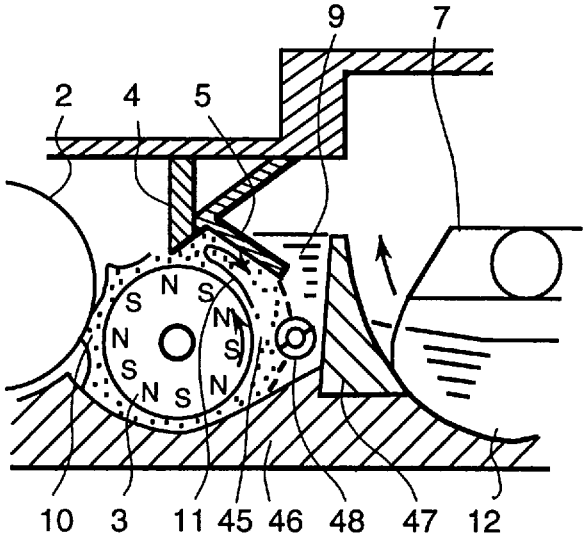
FIG. 11 is a cross-sectional view showing a toner supply portion of a developing apparatus according to the present invention.
Figure 12:
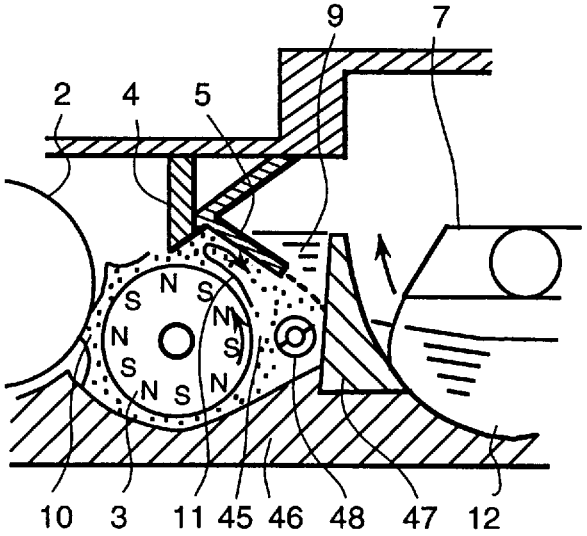
FIG. 12 is a cross-sectional view showing a sufficient toner supply state of the toner supply portion shown in FIG. 11 of a developing apparatus according to the present invention.

In the toner supply system, as shown in FIG. 11 and FIG. 12, the developer guiding plate 5 is provided above the magnetic conveying roller 3, while a developer chamber 45 in which the developer 11 can circulate and the toner reservoir 9 are formed on the opposite side of the magnetic conveying roller 3 from the developing roller 2.

The toner enters into an interior portion of the developer chamber 45 from the toner reservoir 9 in response to a volume change in the developer 11 of the developer chamber 45, and then the toner is mixed with the developer 11 of the developer chamber 45.

The developer chamber 45 occupies a space defined on one side by the magnetic conveying roller 3, by a space regulated by the regulating plate 4 and the developer guiding plate 5 at the top, by a partitioning plate member 47 on the other side and a bottom plate 46 of the developing apparatus. The toner reservoir 9 is formed above the developer chamber 45. The toner in the toner reservoir 9 is supplied from the toner hopper 6 by the agitating blade 7, but in case the amount of toner in the toner reservoir 9 becomes excessive, the toner will automatically over flow and return to the toner hopper 6.

In the above stated toner supply system, as the toner is consumed, as shown in FIG. 11, the volume of developer 11 in the developer chamber 45 becomes small; however, some of the developer 11 is U-turned by the regulating plate 4 and mixed with the incoming toner. In this case, as shown in the figure, a member 48 is arranged in the developer chamber 45, and, by the provision of this member 48 the supply of the toner and the mixture of the toner downwardly moving toner and carrier is promoted.

In a case where the toner is not consumed, as shown in FIG. 12, the volume of the developer 11 in the developer chamber 45 increases, so that the toner reservoir 9 adjacent the developer chamber 45 decreases in size. The toner is regulated by the regulating plate member 45 so that part of its flow is U-turned and the toner becomes positioned outside of the circulating passage of the descending developer 11. As a result, only a slight amount of the toner in the toner reservoir 9 is mixed with the circulating developer 11. Accordingly, since the toner is supplied to he developer 11 in response to the toner consumption, the toner density of the developer 11 can be maintained at a substantially constant level. Therefore, the time lapse stability property of the image quality, such as the image density and the fogging by the toner, can be improved. As a result, it is possible to carry out a mechanical toner density control.

A further example of a developing apparatus according to the present invention will be explained with reference to FIG. 13. The developing apparatus shown in FIG. 13 has the following differences in comparison with the developing apparatus shown in FIG. 1. Namely, the developing apparatus of FIG. 13 further includes a current detecting unit 49A, a toner supply controlling unit 49B and a drive transmitting mechanism 49C, having a clutch.

With the above stated construction, the lower limit value of the toner density is judged by a measurement of the current of the bias current power supply 15, and based on this judgment, the agitating blade 7 is operated and the toner supply to the toner reservoir 9 is intermittently carried out. In the current detecting unit 49A, the current I of the bias power supply 15 is measured and an output signal corresponding to the current I is generated.

Figure 14:
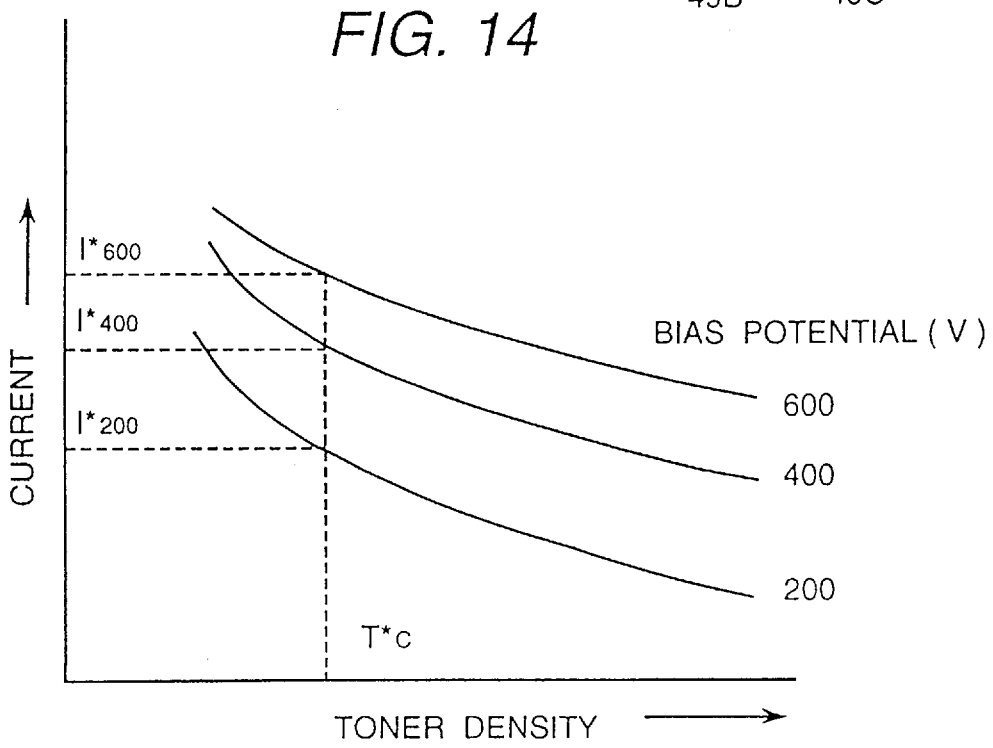
FIG. 14 is a graph showing a relationship between the current of a magnetic conveying roller and a bias power supply and the toner density of a toner supply controlling system of a developing apparatus according to the present invention.

The toner density of the developer 11, the bias potential difference between the developing roller 2 and the magnetic conveying roller 3, and the current I have a relationship as shown in FIG. 14. A current value I* corresponding to a lower limit value T*C of the toner density is set in advance, and this value is stored in the toner supply controlling unit 49B. Further, in the toner supply controlling unit 49B, on the basis of the current I and the bias potential difference, it is judged whether or not the toner density reaches a lower limit of the toner density according to the above stated stored data. In a case where the toner density reaches its lower limit, the agitating blade operation signal is generated. In the drive transmitting mechanism 49*c*, in response to the agitating blade operating signal, an electromagnetic clutch is turned "ON" and the agitating blade 7 is rotated.

In this embodiment of the developing apparatus according to the present invention, since the agitating blade 7 is intermittently operated, the toner stress in the toner hopper 6 can be reduced and the consumption of electric power in the overall developing apparatus can be reduced. Further, for detecting the toner density of the developer 11 on the basis of a measurement of the developing current, it is necessary to maintain a difference in the resistance value between the carrier and the toner and to make this stable over time. For this purpose, the resistance value of the carrier is set within a range of $1/100$–$1/10{,}000$ of the resistance value of the toner and the resistance value of the toner is set within a range of $10^{10}$–$10^{13}$ Ωcm.

Further, as a method of setting the lower limit value of the toner density, a method for detecting magnetic permeability of the developer 11 may be used. Further, the toner accumulating state in the toner reservoir 9 may be measured by an optical sensor and according to the obtained measured value, the operating signal for rotating the agitating blade 7 may be generated.

With respect to the toner, to carry out low temperature fixing, toner having a glass transferring point Tg of 55°–66° C. of the binder resin are used. Further, to improve the fluidity property, the toner may be constituted by one or two kinds of a hard rine processing silica having a mean outer diameter of 10–100 nm and it may also have a different outer diameter, or the combined material of the hard rine processing silica may have an additive agent except for silica (for example, a non-organic oxide material such as oxide titan or oxide aluminum and a conducting agent) as an outside additive agent. Further, as the binder resin for the toner, a styrene-acrylic type resin or polyester type resin having a small oxidation value is desirable because it provides a small moisture adsorption amount and a good anti-environment property.

To reduce the dissipation of the toner to the carrier, it has been ascertained that it is desirable to select a combined material including a conductive resin coated carrier with a toner in which a conductive additive agent is added. A first reason for this is that the stress to the toner can be reduced by applying the resin coating to the carrier, a second reservoir is that the electrostatic charging-up can be restrained by the conductive property the coating agent, and a third reason is that by using toner to which a conductive additive agent is added, the fluctuation of the resistance value of the developer can be restrained.

The above stated developing apparatus may be applied to a color electrophotographic printer system, and further a positively charged organic photoconductor (OPC) may be used as the photoconductor. A electrostatic latent image having a contrast voltage of about 450 V is formed on the surface of the photoconductor 1 having a circumferential speed of 100–400 mm/sec. The circumferential speed Us of the developing roller is set to about 1–2 times that of the circumferential speed of the photoconductor. A developing bias voltage of 250–350 V is applied to the developing roller and positively charged toner is used. With a color electrophotographic printer system having the above stated construction and conditions, reversal development is performed, and, as a result, an image density having 1.3–1.4 (O.D.: optical density) can be secured.

According to this embodiment of the present invention, in the developing apparatus where only non-magnetic toner is coated on the developing roller, it is possible to prevent toner adhesion and to form a uniform toner layer and further to maintain the toner density of the developer held in the magnet body of the magnetic conveying roller. As a result, stable developing of an image can be carried out at a high speed. In case of high speed printing or the use of a low temperature fixing toner, the typical toner filming phenomenon does not occur on the developer over a long period time.

Since it is possible to control the supply of the toner using only a mechanical construction, a sure toner supply at a low cost and with precise toner density control can be carried out. Since the high magnetic force portion corresponding the crest of the magnetic brush shaped layer is enlarged, the amount of toner adhering to the developing roller can be increased, and so the typical stripe-shaped unevenness on the developing roller can be restrained. Further, since the positions of the crest and trough portions of the magnetic brush shaped layer are set minutely, the stripe-shaped unevenness on the developing roller can be prevented and the image density can be made uniform.

Without the provision of a blade member contacting the developing roller, a toner layer having a substantially uniform layer thickness can be formed on the developing roller, and so the occurrence of the typical filming phenomenon due to the toner can be prevented. Since a bias voltage formed by an alternating current voltage superposed on a direct current voltage is applied to the developing roller, the uniformity of the image and prevention of abrasion of the photoconductor can be simultaneously attained.

Using the developing apparatus of the above embodiments according to the present invention, by controlling at least one the electric field of the gap and the circumferential speed ratio between the developing roller and the magnetic conveying roller in accordance with the toner image of each color, the fluctuation of the image density can be prevented, with the result that a clear color picture image can be obtained.

Hereinafter, a further embodiment of a developing apparatus according to the present invention will be explained with reference to FIG. 16.

Figure 16:
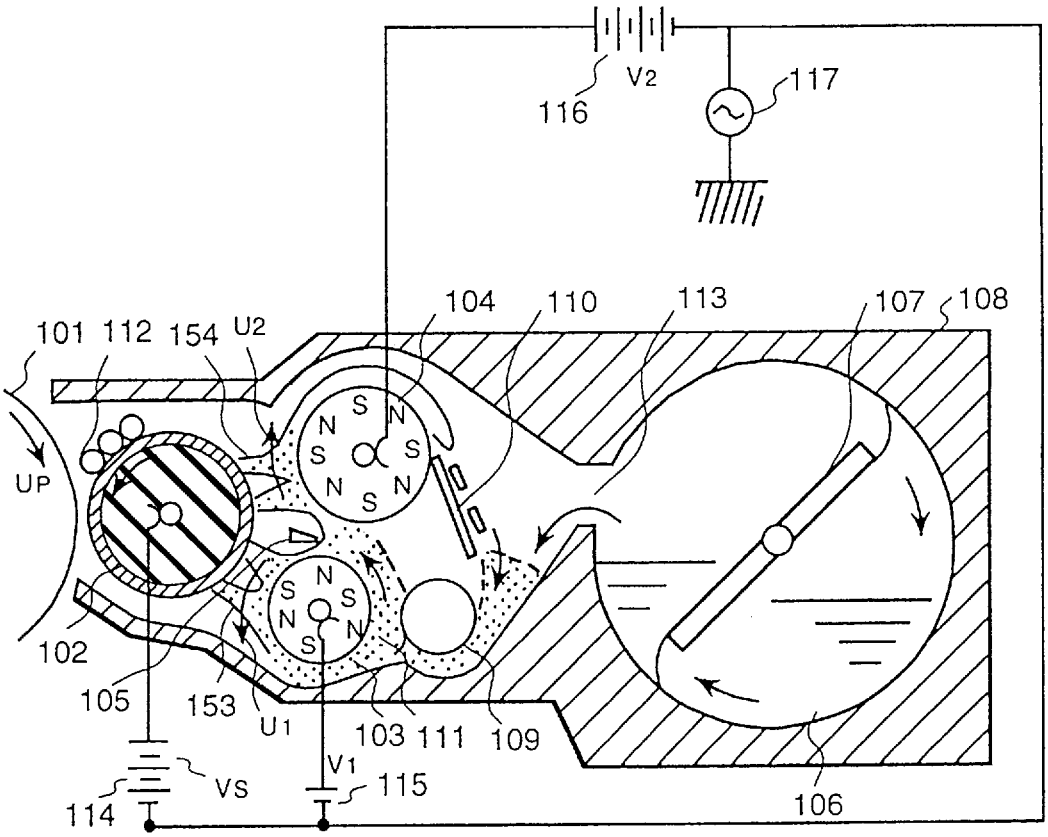
FIG. 16 is a cross-sectional view of a further embodiment of a developing apparatus according to the present invention.

In FIG. 16 there is shown a non-magnetic type mono-component developing apparatus 108 which comprises a photoconductor 101, a developing roller 102 oppositely arranged with respect to the photoconductor 101, a first magnetic conveying roller 103 provided at an upstream side of the developing roller 102 and rotating in a direction opposite thereto, a second magnetic conveying roller 104 provided above the roller 103, and a distributing member 105 disposed between the rollers 103 and 104. The first magnetic conveying roller 103 has a rotation speed of U1 and the second conveying roller 104 has a rotation speed of U2. The developing apparatus 108 further comprises a toner hopper 106, a rotatable agitating blade member 107 provided inside of the toner hopper 106, a further agitating member 109, a scraper 110, developer 111, an opening 113 from the toner hopper 106, DC-bias power supplies 114, 115 and 116, and an AC-bias power supply 117. A respective one of the DC-bias power supplies 114, 115 and 116 provides a respective one of the voltages Vs, V1 and V2.

The toner in the toner hopper 106 is supplied to the vicinity of the agitating member 109 through the opening 113 by rotation of the agitating blade 107. The supplied toner is agitated and mixed with the developer 111 by the agitating member 109 so as to be fed to the first magnetic conveying roller 103.

The developer 111 conveyed by the first magnetic conveying roller 103 is divided by the distributing member 105 into two streams, one of which is supplied to a side of the second magnetic conveying roller 104. The first magnetic conveying roller 103 rotates in a counter-clockwise direction, as shown in FIG. 16, so as to cause a developer magnetic brush shaped layer 153 to move in a direction opposite the rotating direction of the developing roller 102 and into contact therewith. This first magnetic conveying roller 103 has a bias voltage and the electric field applied thereto for attracting the toner onto the developing roller 102. After an electrostatic latent image has been developed on the photoconductor 101 by transfer of toner thereto from the developing roller 102, the residual toner on the developing roller 102 is scraped off and sucked onto the first magnetic conveying roller 103.

The second magnetic conveying roller 104 rotates in a clockwise direction, as shown in FIG. 16, and causes a developer magnetic brush shaped layer 154 to rotate in the same direction as the developing roller 102. Further, the second magnetic conveying roller 104 has a bias voltage applied thereto so that a toner layer 112 is formed on the developing roller 102. The toner layer 112 is formed to have a toner electric charge amount of 5–30 $\mu$c/g, preferably 10–25 $\mu$c/g, and to have a toner adhesion amount of 0.4–1.5 mg/cm, preferably 0.6–1.2 mg/cm. After that, according to the direction of rotation (in FIG. 16, the counter-clockwise direction) of the developing roller 102, the toner layer 112 formed on the surface of the developing roller 102 is conveyed to an oppositely positioned portion of the photoconductor 101. The toner layer 112 is formed to contact the electrostatic latent image formed on the surface of the photoconductor 101, and by the action of the developing electric field, a toner image is formed.

As stated above, the developer 111 comprises carrier and toner, and the developer 111 is conveyed from an upper portion by the first magnetic conveying roller 103 and divided into separate streams by the distributing member 105. The developer 111 is adsorbed and conveyed by the second magnetic conveying roller 104 and contacts the developing roller 102 in the form of the developer magnetic brush shaped layer 154.

Due to the agitation operation and the conveying operation, the toner and carrier are charged with a reverse polarity with respect to each other according to a frictional charging. In this condition, an electric field having a predetermined direction (an order direction electric field) is produced between the second magnetic conveying roller 104 and the developing roller 102. Only toner which has separated from the developer 111 which is held on the second magnetic conveying roller 104 can move toward the developing roller 102, and so a substantially uniform toner image can be formed on the developing roller 102. After that, the toner layer 112 formed on the surface of the developing roller 102 contacts the electrostatic latent image carried on the photoconductor 101 and the toner is transferred to the photoconductor 101, whereby the developing process is carried out.

Thus, in the developing apparatus 108 of this embodiment according to the present invention, it is unnecessary to provide a regulating blade member for contacting the developer in order to form a substantially uniform and thick toner layer 112. Further, since the developing process is carried out using the toner layer 112, the filming phenomenon typically produced by the toner does not occur on the developing roller 102.

Further, the developing apparatus 108 has a controlling unit for controlling the rotation speed and the bias voltage of the first magnetic conveying roller 103 or the second magnetic conveying roller 104. Accordingly, it is possible to change the rotation speed of the first magnetic conveying roller 103 or the second magnetic conveying roller 104. By adjusting the bias voltage of the second magnetic conveying roller 104, it is possible to adjust the electric field strength applied between the second magnetic conveying roller 104 and the developing roller 102.

Further, by adjusting the bias voltage of the first magnetic conveying roller 103, it is possible to select the strength of the electric field and the direction thereof between the first magnetic conveying roller 103 and the developing roller 102. As a result, since the amount of toner which adheres to the developing roller 102 can be adjusted, the stability of the developing apparatus 108 can be improved, and the image quality of the developing apparatus 108 can be maintained at a constant level for a long period of time.

The rotating direction of the developing roller 102 and the photoconductor 101 can set to be the same or opposite to each other. The circumferential speed ratio k of the developing roller 102 and the photoconductor 101 preferably is set to less than 2. The circumferential speed ratio k is preferably set within a range of $1 \leqq k \leqq 1.5$, and the difference in speed V is preferably set within a range of $o \leqq V \leqq 50$ mm/sec.

In particular, with the construction of the developing apparatus 108, since an alternating current voltage of 1–10 KHz and 100–1000 V is superposed on the bias voltage, the uniformity in the image and the abrasion prevention property of the photoconductor 101 can be made compatible.

The developing roller 102 having an elasticity property of a rubber roll having a low hardness (for example, a rubber hardness of about 15–35 (JIS-A)) is fitted into a metal sleeve having an outer diameter of about 20–60 $\mu$m (for example, Ni electrocast sleeve, Al sleeve, non-magnetic type SUS sleeve). The metal sleeve, such as a Ni electrocast sleeve, prevents damage and abrasion of the developing roller 102, and the metal sleeve is made thin to retain the elasticity property of the rubber roll. Therefore, even in a case where the metal sleeve contacts the photoconductor 101, it is possible to maintain a soft contact condition between the metal sleeve and the photoconductor 101. Accordingly, even in a case where the printing speed is high or the circumferential speed ratio k between the developing roller 102 and the photoconductor 101 is large (k=1.5–2.0), it is possible to lengthen the life of the developing roller 102 and the photoconductor 101. The developing roller 102 has an outer diameter of 15–40 mm.

Further, the metal sleeve is desirably formed as a non-magnetic type to prevent the adhesion of the carrier particles. When the metal sleeve is formed as a magnetic type, such as Ni, it is desirable to provide a non-magnetic type body layer (metal or non-metal) on the magnetic type metal sleeve, so as to shield the magnetic path. As the rubber roll of the developing roller 102, either an insulating type roll or a conductive type roll can be employed. In case of the insulating type roll (for example, having resistance value of about $10^{13}$–$10^{16}$ Ωcm), electric power sufficient for establishing a developing bias is applied to the surface of the developing roller 102. However, in the case of a conductive type roll (for example, about $10^{7}$–$10^{8}$ Ωcm), the electric power is applied to the shaft of the developing roller 102.

Further, in case the printing speed is comparatively low, or the circumferential speed ratio k between the developing roller 102 and the photoconductor 101 is substantially one, it is possible to eliminate the use of the metal sleeve for the developing roller 102 and to employ only a rubber roll having a low hardness (for example, the rubber hardness of about 15°–55° (JIS-A)) in a single form or a surface coating form.

The first magnetic conveying roller 103 is arranged to form a gap (a first roller gap) G1 with the developing roller 102 and to form a gap (a first distributing gap) with the distributing member 105 which guides the distributed developer 111 held on the first magnetic conveying roller 103. The first magnetic conveying roller 103 conveys the developer 111 to the vicinity of the distributing member 105 where the developer 111 is introduced through the gap formed between the first magnetic conveying roller 103 and the distributing member 105 in a direction opposite the direction of rotation of the developing roller 102.

Further, the first magnetic conveying roller 103 applies a reverse magnetic field between the first magnetic conveying roller 103 and the developing roller 102. Therefore, the toner layer 112 formed on the developing roller 102 is sucked off and removed. As to the reverse electric field, it is desirable to form this field by superposing an alternating current of 1–10 KHz on a direct current between the first magnetic conveying roller 103 and the developing roller 102.

The first magnetic conveying roller 103 comprises either a single conveying roller, which is magnetized with an equal interval and with a multi-magnetization having 8–32 poles with a magnetized force in the magnetic pole portion within a range of 250–800 gausses or the first magnetic conveying roller 103 may have an uneven interval and multi-magnetization and a sleeve concentrically arranged with respect to the magnet roll. The rotation speed of the first magnetic conveying roller 103 is set to have a ratio (Ut/Us), between the circumferential speed Ut in the first magnetic conveying roller 103 and the circumferential speed Us in the developing roller 102, which is in a range of 1.5–4.0.

The second magnetic conveying roller 104 is arranged to form a gap (the second roller gap) G2 with the developing roller 102 and to form a gap (a second distributing gap) with the distributing member 105 for introducing the distributed portion of the developer 111. In case the magnetic force of the distributing portion of the second magnetic conveying roller 104 is sufficiently stronger than the magnetic force of the distributing portion of the first magnetic conveying roller 103 and the developer 111 can distribute and flow to the side of the second magnetic conveying roller 104 without the provision of the distributing member 105, it is possible to omit the distributing member 105.

DC bias power supplies 114, 115 and 116 are respectively connected to the developing roller 102, the first magnetic conveying roller 103 and the second magnetic conveying roller 104, so that direct current voltages are respectively applied to these elements. More desirably, AC bias power supply 117 is connected to DC bias power supplies 114, 115 and 116, so that an AC voltage of 1–10 KHz superposed on the direct current voltage is applied between the developing roller 102 and the photoconductor 101, and between the first magnetic conveying roller 103 and the second magnetic conveying roller 104 and the developing roller 102.

As the developer 111 held on the first magnetic conveying roller 103 and the second magnetic conveying roller 104, a developer 111 including a carrier having a mean particle diameter of 20–60 $\mu$m and a toner having a mean particle diameter of 5–8 $\mu$m are used. However, to scrape down the residual toner which remains on the surface of the developing roller 102 after the electrostatic latent image has been developed on the photoconductor 101, the inventors of the present invention have found that it is most desirable to set the first roller gap G1 formed between the first magnetic conveying roller 103 and the developing roller 102 to be narrower than the second roller gap G2 formed between the second magnetic conveying roller 104 and the developing roller 102, and further to employ a ferrite carrier. However, by making the removal gap of the first magnetic conveying roller 103 narrower and by increasing the magnetic force and the circumferential speed, a resin carrier and a ferrite carrier can be employed.

As the resin carrier, it is possible to use sphere shaped carrier particles or carrier particles of indefinite shape having an apparent density of 1.0–1.6 g/cm$^3$ and a saturation magnetization of 60–80 emu/g. As a ferrite carrier, it is possible to use carrier particles of substantially spherical shape having an apparent density of 2.2–2.7 g/cm$^3$ and a saturation magnetization of 20–70 emu/g.

Further, in case the agitating member 109 is provided at the side of the toner hopper 106 of the first magnetic conveying roller 103 so that the developer 111 and the toner are mixed and agitated, the time lapsing stability property in the image quality, such as the image density and fogging by the toner, is improved.

It is preferable for the agitating member 109 to have the ability to agitate the mixture in a direction of rotation to move the developer 111 toward the first magnetic conveying roller 103 and the second magnetic conveying roller 104. More specifically, it is possible for the rotating direction of a rotating member in the form of a screw member or an inclined fan member to be repeatedly changed over, or to use two rotating members which rotate in opposite directions that are periodically reversed with respect to each other.

The above stated developing apparatus 108 of this embodiment may be applied to a color electrophotographic printer system, and also a positively charged organic photoconductor (OPC) may be employed as the photoconductor 101. An electrostatic latent image having a contrast voltage of about 450 V is formed on the photoconductor 101 having a circumferential speed of 100–400 mm/sec. The circumferential speed of the developing roller 102 is set to a range of about 1–2 times the circumferential speed of the photoconductor 101. A developing bias voltage of 250–350 V is applied to the developing roller 102 and a positively charged toner is used.

With the color electrophotographic printer system having the above stated construction and conditions, reversal developing is carried out, with the result that an image having a density of 1.3–1.4 (O.D.: optical density) can be secured. Further, even in the case of printing over a long period of time, the typical filming phenomenon due to the toner on the developing roller 102 does not appear.

The developing apparatus 108 according to the present invention, as described with reference to FIG. 16, can be employed as any one or all of the four developing apparatuses 208*a*, 208*b*, 208*c* and 208*d* in the electrophotographic printer system of FIG. 15, as previously described.

In the color electrophotographic printer system of FIG. 15, (1) among the plural developing apparatuses 208*a*, 208*b*, 208*c* and 208*d*, the developing apparatus 108 according to the present invention is shown in more detail with reference to the developing apparatus 208*a*, and (2) an image sensor 227*a*is provided for detecting the toner image of each color (in FIG. 15 only one sensor is illustrated but one is provided for each photoconductor). Further, in the above stated color electrophotographic printer system, (3) in accordance with the detected value of the image sensor 227*a*, the rotation controlling unit 229*a*, the bias controlling unit 230*a* and the picture image controlling unit 228 operate to control the DC bias power supplies 214*a*, 215*a* and 216*a* for the developing roller 202*a* and the magnet body of the magnetic conveying roller, the AC bias power supply 214*a* and the rotation driving portions 216*a* and 217*a*.

In the above stated color electrophotographic printer system, when the color toner image is being formed on the photoconductor and color printing is carried out, since at least one of the electric field and the circumferential speed ratio between the developing roller and the magnetic conveying roller having the magnet body is controlled, the provision of a desired amount of toner on the photoconductor can be ensured. Therefore, even during a long period of printing, since the image density does not become lower and does not fluctuate, the color picture image does not deteriorate.

As a variation of the developing apparatus according to the present invention, the order electric field may be applied between the first magnetic conveying roller 103 and the developing roller 102. As to the circulation of the developer 111, similar to the developing apparatus 108, the developer 111 may be conveyed at the vicinity of the distributing member 105. The developer magnetic brush 153, which is introduced into the gap (the first distributing gap) formed between the first magnetic conveying roller 103 and the distributing member 105, is rotated in a direction opposite the rotating direction of the developing roller 102 and into contact therewith. With this developing apparatus, the operation for sucking and removing the toner layer formed on the developing roller 102 may be less efficient. However, since the order direction electric field is applied between the first magnetic conveying roller 103 and the developing roller 102, the transfer of the toner from the first magnetic conveying roller 103 to the developing roller 102 can be carried out more readily, as compared with the embodiment of FIG. 16.

The total amount of toner coated on the developing roller 102 can be increased by the coating amount additionally applied from the first magnetic conveying roller 103. Further, as a result, the rotation speed of the developing roller 102 can be lowered and can be set to have substantially the same circumferential speed as the photoconductor 101.

Compared with the developing apparatus 108 of FIG. 16, with this variation of the developing apparatus, the resolution in the image can be improved, the frictional load on the photoconductor 101 can be reduced, and the service life of the photoconductor 101 can be lengthened as well.

Figure 17:
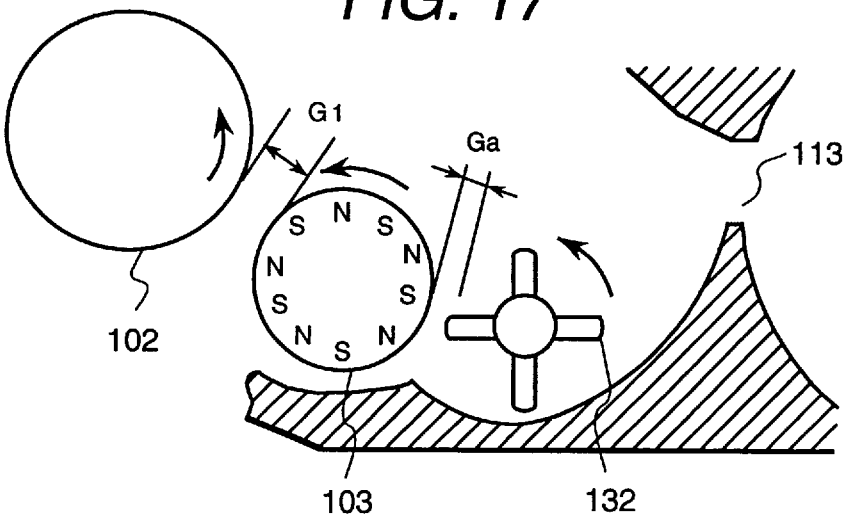
FIG. 17 is a cross-sectional view showing a further embodiment of a developing apparatus according to the present invention.

Another embodiment of the developing apparatus according to the present invention will be explained with reference to FIG. 17. In this embodiment of the developing apparatus, a blade wheel 132 is used as the agitating member, and this blade wheel 132 is arranged closer to the first magnetic conveying roller 103 in comparison to the developing apparatus 108 of FIG. 15. In particular, if the gap Ga formed between the blade wheel 132 and the first magnetic conveying roller 103 is set within a range of about 1½, during a long period of printing, an unevenness in the image density does not occur and also the fogging by the toner can be reduced. Namely, as a result of residual toner on the developing roller 102 being recovered so as to increase the toner density, a developer having a toner density is held at the lower portion of the first magnetic conveying roller 103.

It is understood that, since a toner rich developer is separated from the first magnetic conveying roller 103 by operation of the blade wheel 132 and is agitated and mixed with other developer, the toner density is averaged, the toner electric charging becomes good and a feeble electric charging is avoided.

Figure 18:
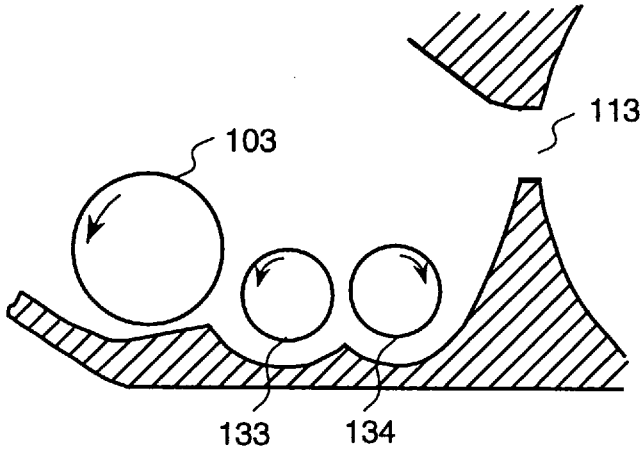
FIG. 18 is a cross-sectional view showing a further embodiment of a developing apparatus according to the present invention.

A further embodiment of the developing apparatus according to the present invention will be explained with reference to FIG. 18. In place of the agitating member 109 in the embodiment of FIG. 16, the developing apparatus has two screw-augers 133 and 134 having different axial conveying directions. In this embodiment of the developing apparatus, during a long period of printing, an unevenness of the image density in the axial direction does not occur and also, in comparison with the embodiment of FIG. 16, the fogging by the toner is further reduced.

When using the non-magnetic type single component development of these embodiments according the present invention, during a long period of printing using low temperature toner, the filming phenomenon due to the toner on the developing roller does not occur.

In a high speed color electrophotographic printer system using the non-magnetic type mono-component development of these embodiments according the present invention, since image density fluctuation can be prevented, a clear color picture image can be secured.

Next, a further embodiment of a developing apparatus according to the present invention will be explained with reference to FIG. 19. In this embodiment of the developing apparatus, instead of the distributing member 105 shown in the embodiment of FIG. 16, the developing apparatus has a regulating plate member 155. Further, the first gap G1 formed between the first magnetic conveying roller 103 and the developing roller 102 is formed to be narrower than the gap Go formed between the first magnetic conveying roller 103 and the regulating plate member 155. Namely, the relationship between the first roller gap G1 and the gap Go is expressed by the following formula (1).

$$G1<Go \quad (1)$$

Figure 19:
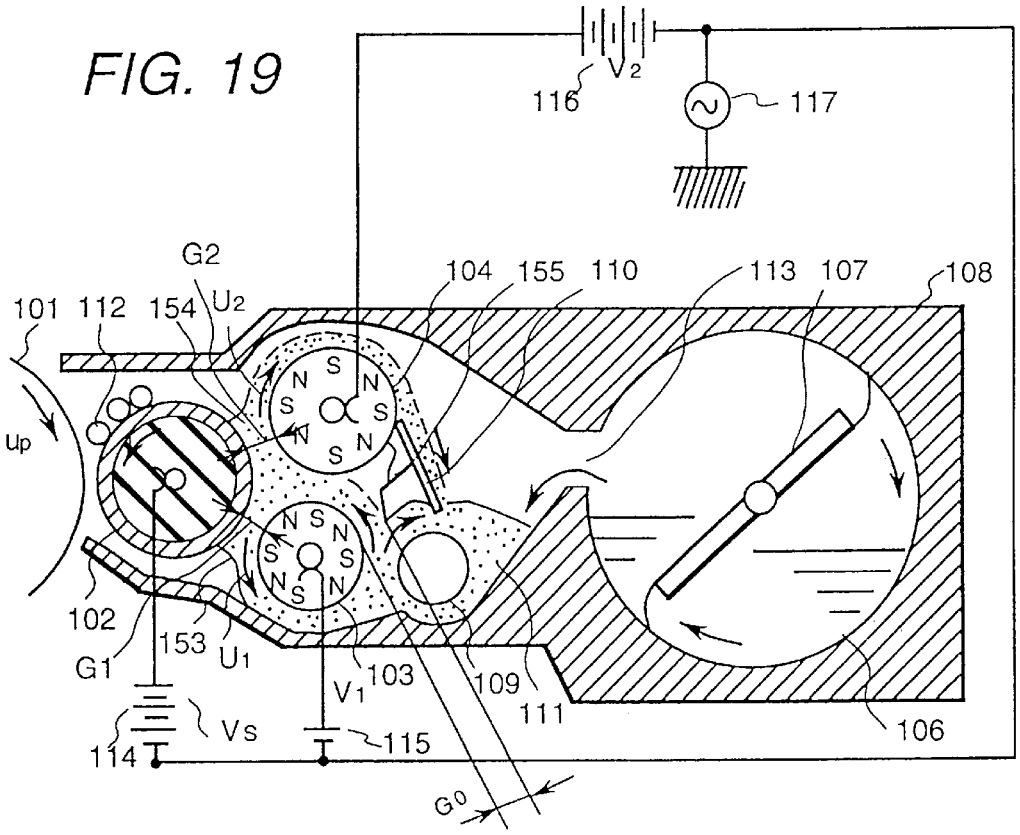
FIG. 19 is a cross-sectional view of a further embodiment of a developing apparatus according to the present invention.
Figure 20:
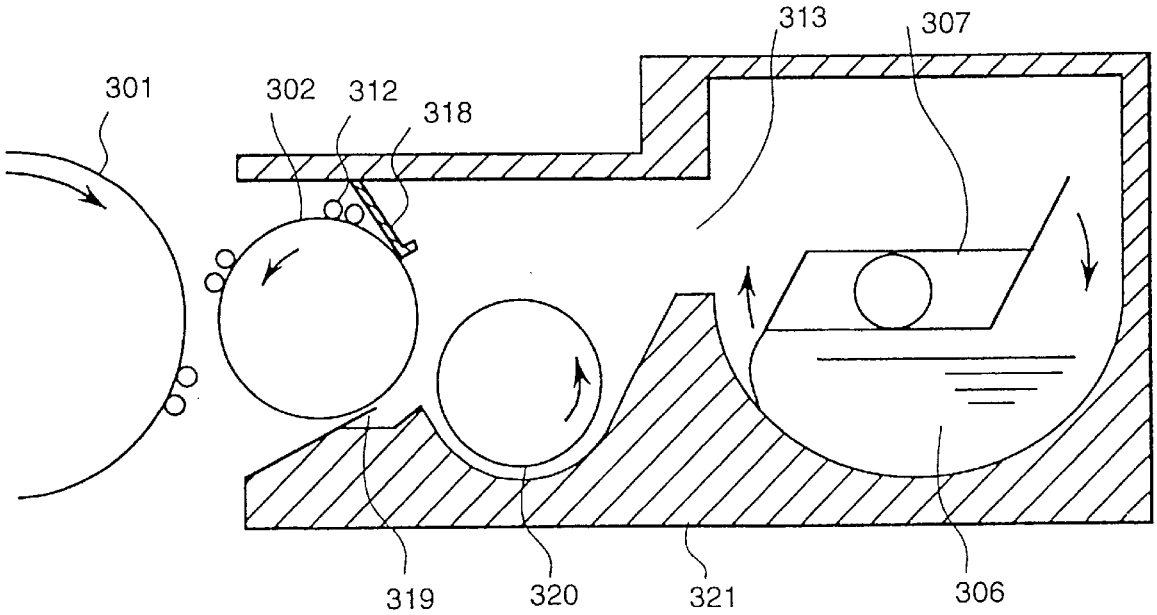
FIG. 20 ( PRIOR ART )
FIG. 20 is a cross-sectional view of a developing apparatus according to the prior art.

With the developing apparatus construction shown in FIG. 19, the amount of the developer 111 conveyed into the first roller gap G1 formed between the first magnetic conveying roller 103 and the developing roller 102 is restrained to be smaller than the amount of the developer 111 conveyed into the gap Go formed between the first magnetic conveying roller 103 and the regulating plate member 155. As a result, an excess amount of the developer 111 flows into the second roller gap G2 formed between the second magnetic conveying roller 104 and the developing roller 102. Accordingly, the developer 111 flowing from the gap Go formed between the first magnetic conveying roller 103 and the regulating plate member 155 is distributed to the first magnetic conveying roller 103 and the second magnetic conveying roller 104. However, if the second roller gap G2 becomes too large, the contact between the developer magnetic brush shaped layer 154 and the developing roller 102 will be insufficient. Therefore, it is desirable for the relationship among the above stated three gaps G1, G2 and Go to be set as shown in a following formula (2).

$$G2 \leqq Go-G1 \quad (2)$$

According to this embodiment of the developing apparatus, it is unnecessary to provide the distributing member 105 shown in FIG. 16 at the intermediate portion between the first magnetic conveying roller 103 and the second magnetic conveying roller 104. Therefore, the developing apparatus can be made more compact in comparison with the developing apparatus shown in FIG. 16 and the above-described variation thereof. Further, the developer, which includes recovered residual toner from the developing roller 102 and has an increased toner density, is held at the lower portion of the first magnetic conveying roller 103. On the other hand, the developer 111, which is held on the lower portion of the first magnetic conveying roller 103, is limited by the regulating plate member 155, and so a part of the developer 111 can fluidize to a vicinity of the agitating member 109. As a result, a toner rich developer (developer including toner having a high toner density) is agitated and mixed with the developer (developer including toner having a low toner density) from the scraper 110.

Accordingly, since the toner density is averaged and the toner charging becomes good and the weakly charged toner decreases, during a long period of printing, an unevenness of the image density does not occur and further the fogging by the toner can he reduced.

We claim:

1. In a developing apparatus in which a toner layer is formed on a surface of a developing roller, said toner layer formed on said developing roller is arranged to contact an electrostatic latent image formed on a surface of a photoconductor, said electrostatic latent image being formed on said photoconductor to attract toner, the developing apparatus comprises:

a developing roller constituted by a deformable thin metal sleeve and an elastic roll fitted into said deformable thin metal sleeve, said developing roller being arranged for contact with said photoconductor;

a magnetic conveying roller rotatively arranged at a position close to said developing roller and having a multi-magnetic-pole type magnet body; and a regulating plate member for regulating the thickness of a layer of a developer, including a carrier and a toner, on the magnetic conveying roller; wherein a developer layer regulated by said regulating plate member contacts said developing roller during rotation of said developer layer; and an electric field is applied between said magnetic conveying roller and said developing roller, so that said toner layer is formed on said surface of said developing roller.

2. A developing apparatus according to claim 1, wherein a ratio between the circumferential speed of said magnetic conveying roller and the circumferential speed of said developing roller is set within a range of 1.5–5.0.

3. A developing apparatus according to claim 1, wherein said developer includes a ferrite carrier having a mean particle diameter of 20–80 $\mu$m and toner having a mean particle diameter of 5–8 $\mu$m.

4. A developing apparatus in which a toner layer is formed on a surface of a developing roller, said toner layer formed on said developing roller is arranged to contact an electrostatic latent image formed on a surface of a photoconductor, said electrostatic latent image being formed on said photoconductor to attract toner, the developing apparatus comprises:

a developing roller constituted by a metal sleeve and an elastic roll fitted into said metal sleeve;

a magnetic conveying roller rotatively arranged at a position close to said developing roller and having a multi-magnetic-pole type magnet body; and a regulating plate member for regulating the thickness of a layer of a developer, including a carrier and a toner, on the magnetic conveying roller; wherein a developer layer regulated by said regulating plate member contacts said developing roller during rotation of said developer layer;

an electric field is applied between said magnetic conveying roller and said developing roller, so that said toner layer is formed on said surface of said developing roller;

a toner reservoir for temporarily collecting toner which is supplied from a toner hopper; and a guiding plate member positioned above said magnetic conveying roller to form an opening which guides toner toward a side of said magnetic conveying roller from a lower portion of said toner reservoir.

5. A developing apparatus according to claim 4, wherein fresh toner is supplied to said opening formed by said guiding plate member at the side of said magnetic conveying roller, and additionally comprising:

a further magnetic conveying roller for mixing toner which is regulated by said regulating plate member so as to flow back toward said opening.

6. A developing apparatus according to claim 5, wherein said further magnetic conveying roller comprises an agitating member.

7. A developing apparatus according to claim 5 or claim 6, wherein another agitating member is provided adjacent said further magnetic conveying roller.

8. A developing apparatus according to claim 7, wherein said another agitating member provided adjacent said further magnetic conveying roller comprises a pair of screw-augers, which cause toner to move along an axial direction of said further magnetic conveying roller.

9. A developing apparatus in which a toner layer is formed on a surface of a developing roller, said toner layer formed on said developing roller is arranged to contact an electrostatic latent image formed on a surface of a photoconductor, said electrostatic latent image being formed on said photoconductor to attract toner, the developing apparatus comprises:

a developing roller constituted by a metal sleeve and an elastic roll fitted into said metal sleeve;

a magnetic conveying roller rotatively arranged at a position close to said developing roller and having a multi-magnetic-pole type magnet body; and a regulating plate member for regulating the thickness of a layer of a developer, including a carrier and a toner, on the magnetic conveying roller; wherein a developer layer regulated by said regulating plate member contacts said developing roller during rotation of said developer layer; and an electric field is applied between said magnetic conveying roller and said developing roller, so that said toner layer is formed on said surface of said developing roller, wherein said magnetic conveying roller is set to have 8–64 magnetic poles and to have a magnetic force at a magnetic pole portion within a range of 250–1000 gausses.

10. A developing apparatus in which a toner layer is formed on a surface of a developing roller, said toner layer formed on said developing roller is arranged to contact an electrostatic latent image formed on a surface of a photoconductor, said electrostatic latent image being formed on said photoconductor to attract toner, the developing apparatus comprises:

a developing roller constituted by a metal sleeve and an elastic roll fitted into said metal sleeve;

a magnetic conveying roller rotatively arranged at a position close to said developing roller and having a multi-magnetic-pole type magnet body; and a regulating plate member for regulating the thickness of a layer of a developer, including a carrier and a toner, on the magnetic conveying roller; wherein a developer layer regulated by said regulating plate member contacts said developing roller during rotation of said developer layer; and an electric field is applied between said magnetic conveying roller and said developing roller, so that said toner layer is formed on said surface of said developing roller, wherein an absolute value of the difference between the width of a first gap which is formed between said developing roller and said magnetic conveying roller and the width of a second gap which is formed between said regulating plate member and said magnetic conveying roller is set within a range of 0–0.4 mm.

11. A developing apparatus in which a toner layer is formed on a surface of a developing roller, said toner layer formed on said developing roller is arranged to contact an electrostatic latent image formed on a surface of a photoconductor, said electrostatic latent image being formed on said photoconductor to attract toner, the developing apparatus comprises:

a developing roller constituted by a metal sleeve and an elastic roll fitted into said metal sleeve;

a magnetic conveying roller rotatively arranged at a position close to said developing roller and having a multi-magnetic-pole type magnet body; and a regulating plate member for regulating the thickness of a layer of a developer, including a carrier and a toner, on the magnetic conveying roller; wherein a developer layer regulated by said regulating plate member contacts said developing roller during rotation of said developer layer; and an electric field is applied between said magnetic conveying roller and said developing roller, so that said toner layer is formed on said surface of said developing roller, wherein a bias voltage is applied to said developing roller which comprises an alternating current voltage superposed on a direct current voltage.

12. A color electrophotographic system apparatus wherein each of plural developing apparatuses charged by a developer corresponding to a respective color is arranged at a periphery of a respective one of plural photoconductors, each of said plural photoconductors forming a respective electrostatic latent image corresponding to a respective color, respective color toner images developed by said plural developing apparatuses are formed on said respective photoconductors, and a toner image having plural colors is formed on a surface of said respective photoconductors, wherein said plural developing apparatuses each comprise a developing apparatus as defined in one of claims 1–5, 8, 9, and 11, and wherein at least one of the electric field and a circumferential speed ratio between said developing roller and said magnetic conveying roller is controlled in accordance with the respective color toner images.

13. In a developing apparatus in which a toner layer is formed on a surface of a developing roller, said toner layer formed on said developing roller being positioned to contact electrostatic latent image formed on a surface of a photoconductor, the developing apparatus comprises:

a developing roller constituted by a deformable thin metal sleeve formed by one of a non-magnetic body and a feeble magnetic body and an elastic roll fitted into said deformable thin metal sleeve, said developing roller being arranged for contact with said photoconductor;

a magnetic conveying roller rotatively arranged at a position close to said developing roller and having a multi-magnetic-pole type magnet body; and a regulating plate member for regulating the thickness of a layer of a developer, including a carrier and a toner, on the magnetic conveying roller;

wherein a developer layer regulated by said regulating plate member contacts said developing roller during rotation of said developer layer; and an electric field is applied between said magnetic conveying roller and said developing roller, so that said toner layer is formed on said surface of said developing roller.

14. A developing apparatus according to claim 13, further comprising:

a current detection unit for detecting a secondary side current of a bias current applied to said magnetic conveying roller;

a toner compensation controlling unit; and a drive transmitting mechanism for carrying out on-off operation of rotation of an agitating member for compensation of the toner;

whereby in accordance with the detected current, toner compensation is controlled intermittently.

15. A developing apparatus in which a toner layer is formed on a surface of a developing roller, said toner layer formed on said developing roller being positioned to contact electrostatic latent image formed on a surface of a photoconductor, the developing apparatus comprises:

a developing roller constituted by a metal sleeve formed by one of a non-magnetic body and a feeble magnetic body and an elastic roll fitted into said metal sleeve;

a magnetic conveying roller rotatively arranged at a position close to said developing roller and having a multi-magnetic-pole type magnet body; and a regulating plate member for regulating the thickness of a layer of a developer, including a carrier and a toner, on the magnetic conveying roller;

wherein a developer layer regulated by said regulating plate member contacts said developing roller during rotation of said developer layer; and an electric field is applied between said magnetic conveying roller and said developing roller, so that said toner layer is formed on said surface of said developing roller;

a toner reservoir for temporarily collecting toner which is supplied from a toner hopper;

a developer chamber provided on a side of said magnetic conveying roller opposite said developing roller for circulating said developer; and a guiding plate member for guiding the toner to said developer chamber from a lower portion of said toner reservoir, whereby the toner is supplied from said toner reservoir according to the volume change of said developer in said developer chamber.

16. A developing apparatus according to claim 15, wherein said guiding plate member is provided above said magnetic conveying roller.

17. A developing apparatus according to one of claims 13 and 15, wherein said developer includes conductive resin coated carrier having a mean particle diameter of 30–80 $\mu$m and toner with a conductive additive agent having a mean particle diameter of 5–8 $\mu$m.

18. A developing apparatus in which a toner layer is formed on a surface of a developing roller, said toner layer formed on said developing roller being positioned to contact electrostatic latent image formed on a surface of a photoconductor, the developing apparatus comprises:

a developing roller constituted by a metal sleeve formed by one of a non-magnetic body and a feeble magnetic body and an elastic roll fitted into said metal sleeve;

a magnetic conveying roller rotatively arranged at a position close to said developing roller and having a multi-magnetic-pole type magnet body; and a regulating plate member for regulating the thickness of a layer of a developer, including a carrier and a toner, on the magnetic conveying roller;

wherein a developer layer regulated by said regulating plate member contacts said developing roller during rotation of said developer layer; and an electric field is applied between said magnetic conveying roller and said developing roller, so that said toner layer is formed on said surface of said developing roller, wherein said magnetic conveying roller is formed with plural magnet bodies arranged as magnetic pole pairs having the same polarity.

19. A developing apparatus in which a toner layer is formed on a surface of a developing roller, said toner layer formed on said developing roller being positioned to contact electrostatic latent image formed on a surface of a photoconductor, the developing apparatus comprises:

a developing roller constituted by a metal sleeve formed by one of a non-magnetic body and a feeble magnetic body and an elastic roll fitted into said metal sleeve;

a magnetic conveying roller rotatively arranged at a position close to said developing roller and having a multi-magnetic-pole type magnet body; and a regulating plate member for regulating the thickness of a layer of a developer, including a carrier and a toner, on the magnetic conveying roller;

wherein a developer layer regulated by said regulating plate member contacts said developing roller during rotation of said developer layer; and an electric field is applied between said magnetic conveying roller and said developing roller, so that said toner layer is formed on said surface of said developing roller, wherein said magnetic conveying roller is set to have 8–64 magnetic poles, and wherein a ratio between the circumferential speed of said magnetic conveying roller and the circumferential speed of said developing roller is set within a range of 1.5–5.0.

20. A developing apparatus in which a toner layer is formed on a surface of a developing roller, said toner layer formed on said developing roller being positioned to contact electrostatic latent image formed on a surface of a photoconductor, the developing apparatus comprises:

a developing roller constituted by a metal sleeve formed by one of a non-magnetic body and a feeble magnetic body and an elastic roll fitted into said metal sleeve;

a magnetic conveying roller rotatively arranged at a position close to said developing roller and having a multi-magnetic-pole type magnet body; and a regulating plate member for regulating the thickness of a layer of a developer, including a carrier and a toner, on the magnetic conveying roller;

wherein a developer layer regulated by said regulating plate member contacts said developing roller during rotation of said developer layer; and an electric field is applied between said magnetic conveying roller and said developing roller, so that said toner layer is formed on said surface of said developing roller, wherein an absolute value of the difference between the width of a first gap which is formed between said developing roller and said magnetic conveying roller and the width of a second gap which is formed between said regulating plate member and said magnetic conveying roller is set within a range of 0–0.4 mm.

21. A developing apparatus in which a toner layer is formed on a surface of a developing roller, said toner layer formed on said developing roller being positioned to contact electrostatic latent image formed on a surface of a photoconductor, the developing apparatus comprises:

a developing roller constituted by a metal sleeve formed by one of a non-magnetic body and a feeble magnetic body and an elastic roll fitted into said metal sleeve;

a magnetic conveying roller rotatively arranged at a position close to said developing roller and having a multi-magnetic-pole type magnet body; and a regulating plate member for regulating the thickness of a layer of a developer, including a carrier and a toner, on the magnetic conveying roller;

wherein a developer layer regulated by said regulating plate member contacts said developing roller during rotation of said developer layer; and an electric field is applied between said magnetic conveying roller and said developing roller, so that said toner layer is formed on said surface of said developing roller, wherein a bias voltage is applied to said developing roller which comprises alternating current voltage superposed on a direct current voltage.

22. A color electrophotographic apparatus wherein each of plural developing apparatuses charged by a developer corresponding to a respective color is arranged at a periphery of a respective one of plural photoconductors, each of said plural photoconductors forming a respective electrostatic latent image corresponding to a respective color, respective color toner images developed by said plural developing apparatuses are formed on said respective photoconductors, and a toner image having plural colors is formed on a surface of said respective photoconductors, wherein each of said plural developing apparatuses comprises a developing apparatus as defined in one of claims 13, 15, 18, 19, 20 and 21, and wherein at least one of the electric field and a circumferential speed ratio between said developing roller and said magnetic conveying roller is controlled in accordance with the respective color toner image.

23. In a developing apparatus where a toner layer is formed on a surface of a developing roller, said toner layer on said developing roller being positioned to contact an electrostatic latent image formed on a surface of a photoconductor, the developing apparatus comprises:

a developing roller constituted by a metal sleeve and an elastic roll fitted into said metal sleeve;

a first magnetic conveying roller rotatively arranged close to said developing roller and having a first magnet body;

a second magnetic conveying roller rotatively arranged close to said developing roller and having a second magnet body; and a distributing member provided at an intermediate position between said first magnetic conveying roller and said second magnetic conveying roller; wherein said distributing member distributes a developer, including a carrier and toner held on said first magnetic conveying roller to said second magnetic conveying roller;

the developer held on said first magnetic conveying roller and the developer held on said second magnetic conveying roller are conveyed into contact with said developing roller; and electric fields having different directions from each other are applied between said first magnetic conveying roller and said second magnetic conveying roller and said developing roller, whereby only a layer of toner is formed on said surface of said developing roller.

24. A developing apparatus according to claim 23, wherein, the developer held on said first magnetic conveying roller is caused to contact said developing roller while rotating in a direction opposite the rotating direction of said developing roller, and the developer held on said second magnetic conveying roller is caused to contact said developing roller while moving in the same rotating direction as the rotating direction of said developing roller.

25. A developing apparatus according to claim 23, wherein at the intermediate positions between said first magnetic conveying roller and said second magnetic conveying roller, the magnetic force of said second magnetic conveying roller is set to be larger than the magnetic force of said first magnetic conveying roller.

26. A developing apparatus according to claim 23, wherein the width of a first roller gap formed between said developing roller and said first magnetic conveying roller is set to be smaller than the width of a second roller gap formed between said developing roller and said second magnetic conveying roller.

27. A developing apparatus according to claim 23, wherein a ratio between the circumferential speed of said second magnetic conveying roller and the circumferential speed of said developing roller is set within a range of 1.5–3.0.

28. A developing apparatus according to claim 23, wherein said developer includes a ferrite carrier having a mean particle diameter of 20–60 $\mu$m and toner having a mean particle diameter of 5–8 $\mu$m.

29. A developing apparatus according to claim 23, wherein a bias voltage is applied to said developing roller which comprises an alternating current voltage superposed on a direct current voltage.

30. In a developing apparatus where a toner layer is formed on a surface of a developing roller, said toner layer on said developing roller being positioned to contact an electrostatic latent image formed on a surface of a photoconductor, the developing apparatus comprises:

a developing roller constituted by a metal sleeve and an elastic roll fitted into said metal sleeve;

a first magnetic conveying roller rotatively arranged close to said developing roller and having a first magnet body; and a second magnetic conveying roller rotatively arranged close to said developing roller and having a second magnet body; and a distributing member provided at an intermediate position between said first magnetic conveying roller and said second magnetic conveying roller; wherein said distributing member distributes a developer, including a carrier and toner, held on said first magnetic conveying roller to said second magnetic conveying roller;

the developer held on said first magnetic conveying roller is conveyed into contact with said developing roller in the same rotating direction as the rotating direction of said developing roller;

the developer held on said second magnetic conveying roller is conveyed into contact with said developing roller in a rotating direction opposite the rotating direction of said developing roller; and electric fields having the same directions are applied between said first magnetic conveying roller and said second magnetic conveying roller and said developing roller, whereby only a layer of toner is formed on said surface of said developing roller.

31. A color electrophotographic system apparatus wherein each of plural developing apparatuses charged by a developer corresponding to a respective color is arranged at a periphery of a respective one of plural photoconductors, each of said plural photoconductors forming a respective electrostatic latent image corresponding to a respective color, respective color toner images developed by each of said plural developing apparatuses are formed on respective photoconductors, wherein said plural developing apparatuses each comprise a developing apparatus as defined in one of claims 23–30, at least one of the electric field and a circumferential speed ratio between said developing roller and said second magnetic conveying roller is controlled in accordance with a respective color toner image.

32. A developing apparatus in which developing is carried out by causing a photoconductor to contact a developing roller having a toner layer formed on a surface thereof, comprising:

a developing roller constituted by an elastic roll, a first magnetic conveying roller having a first magnet body and rotatively arranged close to said developing roller, and a second magnetic conveying roller having a second magnet body and rotatively arranged close to said developing roller, wherein a developer, which has been absorbed and sucked by said first magnetic conveying roller onto a surface thereof, is distributed to said second magnetic conveying roller, and a toner layer is formed on the surface of said developing roller by applying a bias voltage into said first magnetic conveying roller and said second magnetic conveying roller.

33. A developing apparatus in which the developing is carried out by causing a photoconductor to contact a developing roller having a toner layer formed on a surface thereof, comprising:

a developing roller constituted by a metal sleeve and an elastic roll fitted into said metal sleeve, a first magnetic conveying roller having a first magnet body and rotatively arranged close to said developing roller, a second magnetic conveying roller having a second magnet body and rotatively arranged close to said developing roller, and a regulating plate member for regulating the thickness of a developer which has been absorbed magnetically by said first magnetic conveying roller on a surface thereof, wherein a relationship, among a gap (Go) formed between said first magnetic conveying roller and said regulating plate member, a first roller gap (G1) formed between said first magnetic conveying roller and said developing roller, and a second roller gap (G2) formed between said second magnetic conveying roller and said developing roller, is satisfied by a first following formula (1) and by a second following formula (2):

$$G1<Go \quad (1)$$

$$G2 \leqq Go-G1 \quad (2)$$

developer absorbed by said first magnetic conveying roller is distributed to said second magnetic conveying roller, and a toner layer is formed on said developing roller by applying a bias voltage to said first magnetic conveying roller and said second magnetic conveying roller.

34. A developing apparatus in which a toner layer is formed on a surface of a developing roller, said toner layer formed on said developing roller being positioned to contact electrostatic latent image formed on a surface of a photoconductor, the developing apparatus comprises:

a developing roller constituted by a metal sleeve formed by one of a non-magnetic body and a feeble magnetic body and an elastic roll fitted into said metal sleeve;

a magnetic conveying roller rotatively arranged at a position close to said developing roller and having a multi-magnetic-pole type magnet body; and a regulating plate member for regulating the thickness of a layer of a developer, including a carrier and a toner, on the magnetic conveying roller;

wherein a developer layer regulated by said regulating plate member contacts said developing roller during rotation of said developer layer; and an electric field is applied between said magnetic conveying roller and said developing roller, so that said toner layer is formed on said surface of said developing roller, wherein said metal sleeve is constituted by a nonmagnetic body layer or a feeble magnetic body layer on a surface of a Ni electrocast sleeve.

35. In a developing apparatus where a toner layer is formed on a surface of a developing roller, said toner layer on said developing roller being positioned to contact an electrostatic latent image formed on a surface of a photoconductor, the developing apparatus comprises:

a developing roller constituted by a metal sleeve and an elastic roll fitted into said metal sleeve;

a first magnetic conveying roller rotatively arranged close to said developing roller and having a first magnet body;

a second magnetic conveying roller rotatively arranged close to said developing roller and having a second magnet body;

a developer, including a carrier and toner, being held on said first magnetic conveying roller and said second magnetic conveying roller, the developer held on said first magnetic conveying roller and the developer held on said second magnetic conveying roller being conveyed into contact with said developing roller; and electric fields having different directions from each other being applied between said first magnetic conveying roller and said second magnetic conveying roller and said developing roller, whereby only a layer of toner is formed on said surface of said developing roller.

36. In a developing apparatus where a toner layer is formed on a surface of a developing roller, said toner layer on said developing roller being positioned to contact an electrostatic latent image formed on a surface of a photoconductor, the developing apparatus comprises:

a developing roller constituted by a metal sleeve and an elastic roll fitted into said metal sleeve;

a first magnetic conveying roller rotatively arranged close to said developing roller and having a first magnet body; and a second magnetic conveying roller rotatively arranged close to said developing roller and having a second magnet body;

a developer, including a carrier and toner, being held on said first magnetic conveying roller and said second magnetic conveying roller, the developer held on said first magnetic conveying roller being conveyed into contact with said developing roller in the same rotating direction as the rotating direction of said developing roller, and the developer held on said second magnetic conveying roller being conveyed into contact with said developing roller in a rotating direction opposite the rotating direction of said developing roller; and electric fields having the same directions being applied between said first magnetic conveying roller and said second magnetic conveying roller and said developing roller, whereby only a layer of toner is formed on said surface of said developing roller.

* * * * *